US006431544B1

(12) United States Patent
Kagami

(10) Patent No.: US 6,431,544 B1
(45) Date of Patent: Aug. 13, 2002

(54) PUZZLE FOR RECONSTRUCTING AN OVERALL PICTURE

(76) Inventor: Tetsuya Kagami, 2-291 Tachibana, Oohito-cho, Tagata-gun, Shizuoka (JP)

( * ) Notice: Subject to any disclaimer, the term of this patent is extended or adjusted under 35 U.S.C. 154(b) by 0 days.

(21) Appl. No.: 09/535,538

(22) Filed: Mar. 27, 2000

(30) Foreign Application Priority Data

Mar. 30, 1999 (JP) ..... 11-090093

(51) Int. Cl.[7] ..... A63F 9/10

(52) U.S. Cl. ..... 273/157 R; 273/153 R; 273/156; 273/153; 273/292

(58) Field of Search ..... 273/153 R, 156, 273/157 R, 292, 302, 307, 308, 293, 284, 283, 139

(56) References Cited

U.S. PATENT DOCUMENTS 3,645,534 A * 2/1972 Weisbecker
3,815,920 A * 6/1974 Carter et al.
4,637,799 A * 1/1987 Bouchal
4,715,605 A * 12/1987 Fritzman
4,815,742 A * 3/1989 Augustine
4,867,455 A * 9/1989 Fritzman
5,209,480 A * 5/1993 Katz
5,632,488 A * 5/1997 Sturm et al.
6,024,578 A * 2/2000 Dandl

* cited by examiner

*Primary Examiner*—Paul T. Sewell
*Assistant Examiner*—Nini F. Legesse
(74) *Attorney, Agent, or Firm*—Rader, Fishman and Grauer PLLC

(57) ABSTRACT

A puzzle in the form of stacks which eliminates troublesome handling, and presents high versatility as amusement. An overall picture as a correct combination is divided into a plurality of segmental pictures which are separately displayed on different cards, each of which is placed in a plurality of cards belonging to one of stacks equal in number to the plurality of segmental pictures. A card displaying one of the segmental pictures is selected from a plurality of cards of each stack for exposure, and selected cards are placed in close proximity to assemble the segmental pictures to reconstruct the overall pictures on the cards.

13 Claims, 39 Drawing Sheets

PUZZLE FOR RECONSTRUCTING AN OVERALL PICTURE

BACKGROUND OF THE INVENTION

1. Field of the Invention

The present invention relates to puzzles for playing by assembling cards into a complete figure or the like, and items associated therewith.

2. Description of the Related Art

Conventionally, a jig-saw puzzle is well known, for example, as the type of puzzle mentioned above. The jig-saw puzzle is comprised of a plurality of divided pieces which represent, when completely assembled, a figure or the like. Before use, the pieces are separately contained in a box or the like. When in use, the pieces are assembled one by one on a planar surface such as a table by fitting each salient formed on a side of each piece into a corresponding recess formed on a side of a different piece, thus reconstructing a target predetermined figure or the like.

Due to the nature of the jig-saw puzzle resulting from its form, the jig-saw puzzle has the following difficulties in handling. First, when playing in a vehicle such as a train, for example, joggling and vibrations of the vehicle prevent a player from fitting one piece into another. Second, for replacing pieces after use, a laborious work is required for separating pieces, fitted together, one by one to accommodate separated pieces in the box. Further, since the pieces are separate, the total number of pieces must be counted for confirming whether or not one complete set of pieces is present. In addition, such small pieces are readily missing. Furthermore, since a set of pieces for a jig-saw puzzle is limited to only one figure or the like reconstructed from the pieces, the jig-saw puzzle lacks the versatility as amusement.

OBJECTS AND SUMMARY OF THE INVENTION

In view of the foregoing problems, which the present invention has been made to solve, it is an object of the present invention to provide puzzles in the form of stacks which eliminates laborious handling before, after and during use, and exhibits high versatility as amusement.

It is another object of the present invention to provide sheet materials suitable for creating cards constituting a puzzle, a bag suitable for keeping cards and adjusting a positional relationship of the cards, card fixtures suitable for facilitating the display of figures on cards constituting a puzzle, and an intermediate layer which facilitates removable of cards, once fixed to the card fixture, from the card fixture.

To achieve the above objects, in a first aspect, the present invention provides a puzzle for reconstructing an overall picture by assembling a plurality of segmental pictures divided from the overall picture. The puzzle includes a number of stacks equal to the number of segmental pictures, wherein each of the stacks includes a plurality of cards, each of the card displays one of the segmental pictures, and cards displaying associated segmental pictures divided from the same overall picture are selected from each of the plurality of stacks for exposure, and assembled to reconstruct the overall picture.

In this puzzle, each of the card may include reconstruction information for reconstructing an overall picture associated with a segmental picture displayed thereon.

In a second aspect, the present invention provides a puzzle for reconstructing an overall picture by assembling a plurality of segmental pictures divided from the overall picture. The puzzle includes a puzzle body having a number of stacks equal to the number of segmental pictures, wherein each of the stacks includes a plurality of cards, each of the card displays one of the segmental pictures, and cards displaying associated segmental pictures divided from the same overall picture are selected from each of the plurality of stacks for exposure, and assembled to reconstruct the overall picture, and a reconstruction information stack including a plurality of cards, each of the cards including reconstruction information for reconstructing an overall picture associated with a segmental picture displayed thereon, and a field for a player to write the reconstruction information.

In the puzzle described above, the stack may further include a holder inserted through a hole formed through each of the cards. Each of the cards may be formed with a plurality of holes, and the stack may include a plurality of holders. Each of the cards may also include a notch formed on at least one side thereof for fitting the holder therein when the holder is rotated about a portion thereof extending through the hole, wherein the notch has a depth equal to or larger than a thickness of the holder.

In a third aspect, the present invention provides a puzzle sheet which includes a continuous sheet surface having an area corresponding to an area of a plurality of cards arranged side by side; cut lines formed on at least one side of the puzzle sheet for cutting the puzzle sheet into cards therealong and for serving as boundaries of the cards; and a plurality of holes formed within areas defined by the cut lines, which correspond to holes formed through the cards for inserting a holder therethrough.

In a fourth aspect, the present invention provides a bag for keeping a puzzle, which includes holes extending through both sides thereof, and corresponding to holes formed through cards constituting the puzzle for inserting a holder therethrough.

In a fifth aspect, the present invention provides a card fixture which includes a substrate having a size corresponding to a size of at least one card constituting a puzzle; and protrusions formed on a top surface of the substrate in the same positional relationship with holes formed through the cards.

In a sixth aspect, the present invention provides an intermediate layer interposed between a card fixture and a plurality of cards when the cards are fixed on the card fixture. The intermediate layer, having a size covering a top surface of the card fixture, includes holes formed therethrough for inserting protrusions formed on the card fixture for fixing cards; and at least one salient formed on the periphery for removing the cards from the card fixture.

Those and other objects, features and advantages of the present invention will become apparent from the following detailed description of various embodiments thereof, when taken in conjunction with the accompanying drawings.

It should be noted that the "picture" which is represented by the terms, "overall picture" and "segmental picture" herein, is not limited to what is represented by the general semantic concept of a "picture," but includes everything that is visually recognizable, such as various figures, designs, photographs, patterns, letters, symbols, colors, etc., as the characteristics of the present invention.

DETAILED DESCRIPTION OF THE PREFERRED EMBODIMENTS

Figure 1:
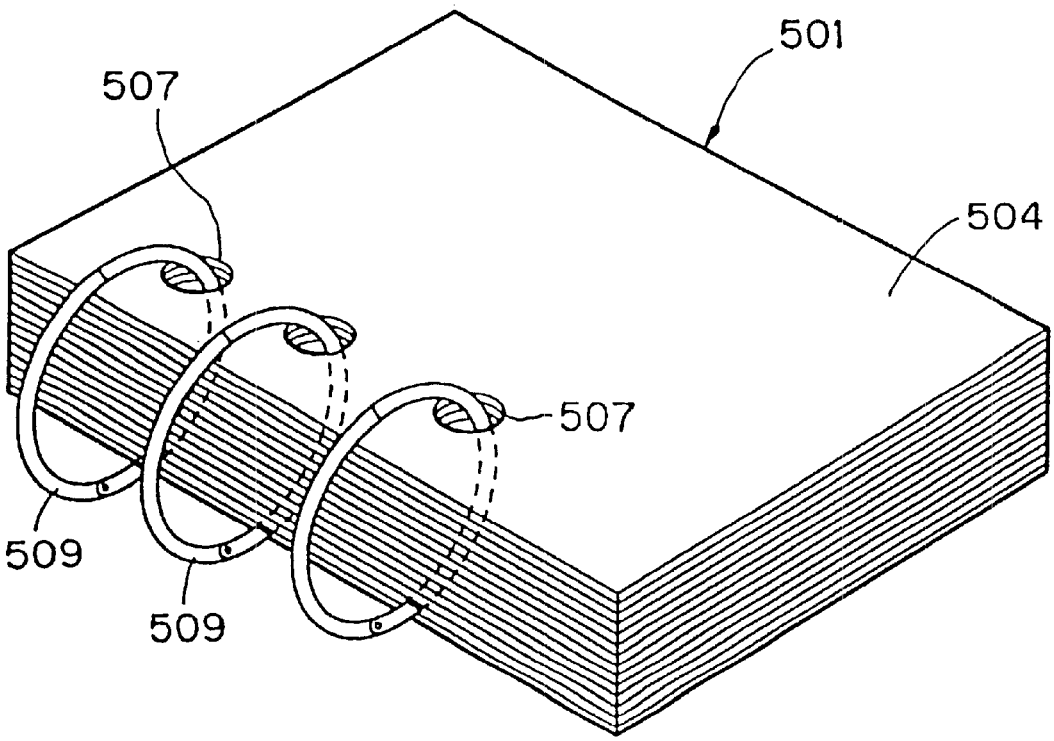
FIG. 1 is a perspective view illustrating a stack forming part of a puzzle according to a first embodiment of the present invention.

The present invention will hereinafter be described in connection with several embodiments thereof with reference to the accompanying drawings in which the same elements are designated the same reference numerals throughout respective embodiments, and repetitive explanation on the same elements is omitted.

A first embodiment of a puzzle according to the present invention will now be described with reference to FIGS. 1 to 4. The puzzle of this embodiment is comprised of two stacks which are identical except for representations realized on respective cards to constitute the puzzle, so that only one of the stacks will be described below. A stack 501 includes a plurality of stacked cards 504, and a plurality of ring-shaped holders 509 extending through a plurality of holes 507 formed through respective cards 504. The holders 509 may be opened to remove the card(s) 504 from the stack 501 and closed after the removal.

Figure 2:
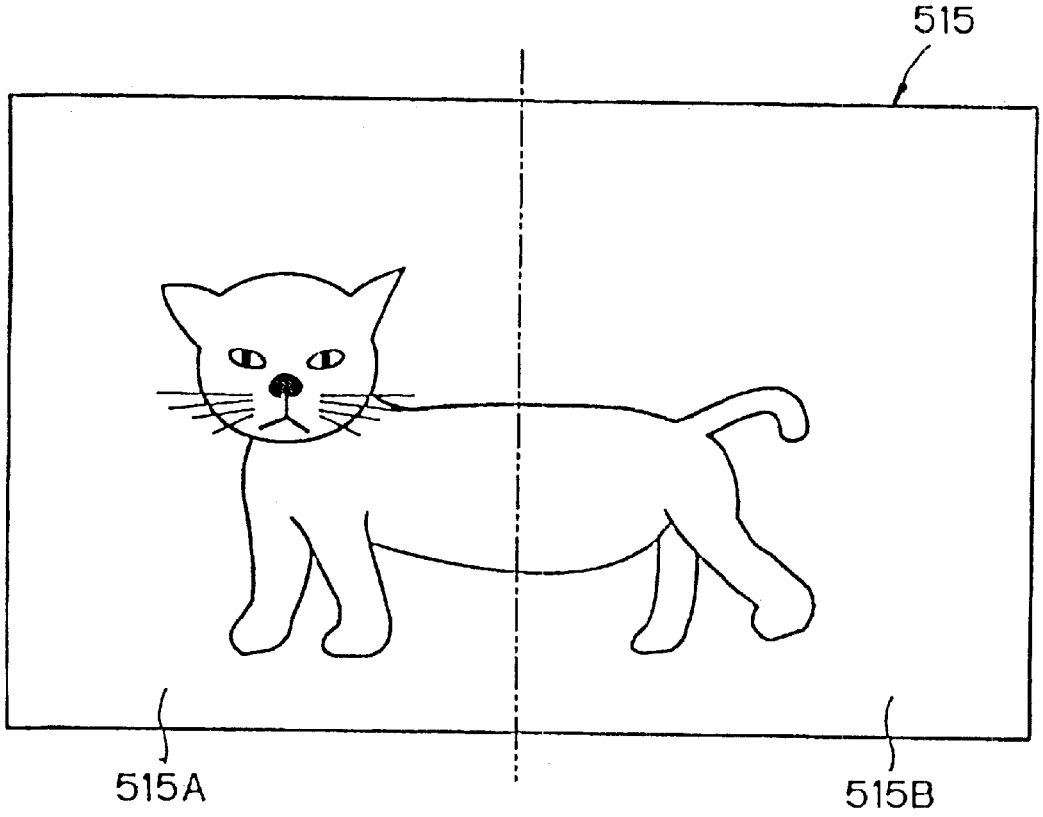
FIG. 2 is a top plan view illustrating an overall picture as a correct combination of the puzzle according to the first embodiment.

The illustrated puzzle is played in such a manner that the cards 504 of both the stacks 501 are turned over one by one to find matching of cards 504 of the respective stacks 501 to thereby give a correct combination. More specifically, the structure of the puzzle will be described below in connection with an exemplary combination which is, in this particular example, a figure of the whole body of a cat that is reconstructed by matching two cards 504, as illustrated in FIG. 2. As the correct combination of the puzzle, an overall picture 515 depicting the whole body of a cat is set. The overall picture 515 is divided along a two-dot chain line drawn in FIG. 2 into two segmental pictures 515A and 515B. The overall picture 515 are divided into two because the puzzle is comprised of two stacks 501 as mentioned above.

Figure 3:
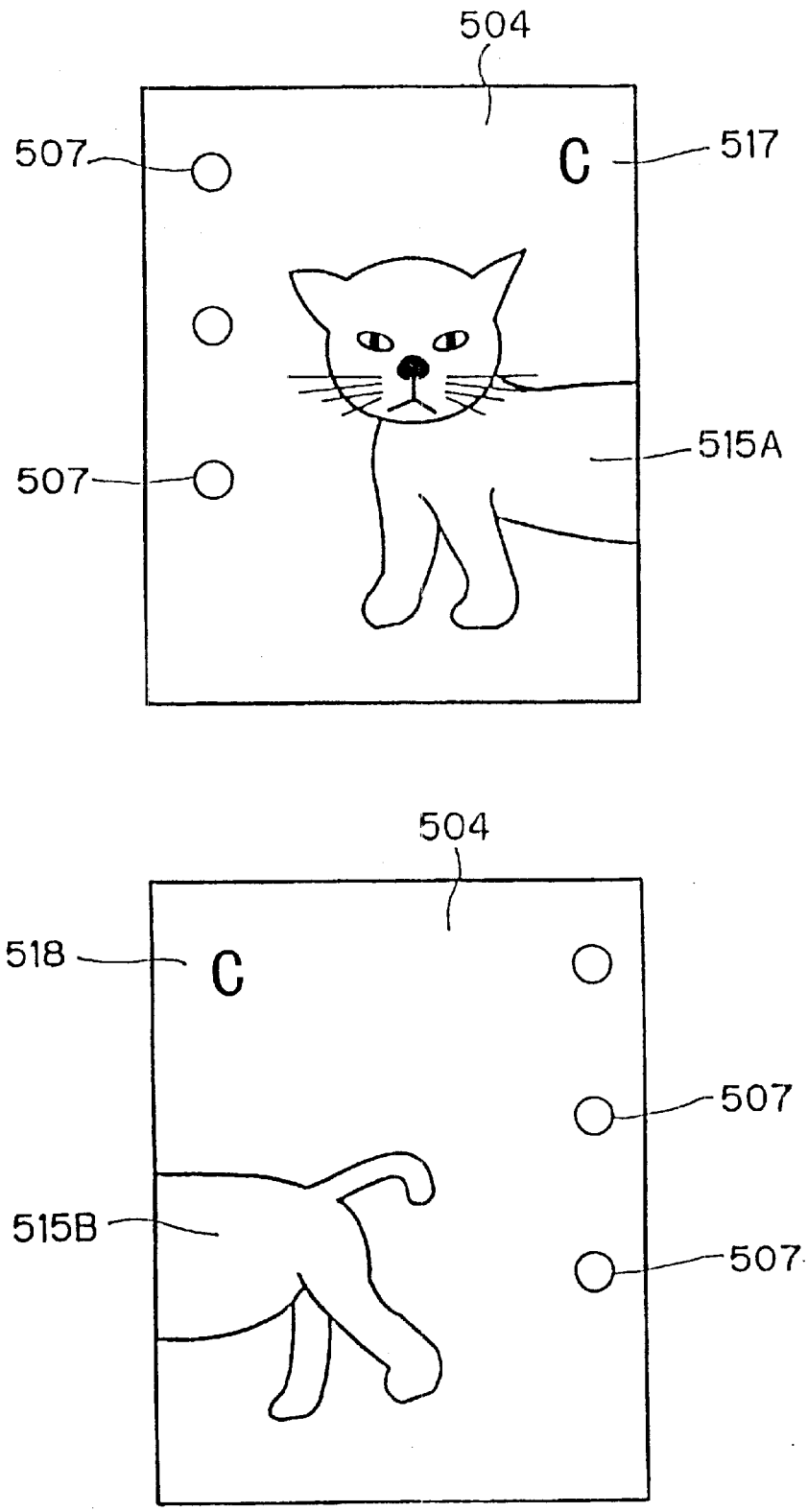
FIG. 3 is a top plan view illustrating cards forming part of the puzzle according to the first embodiment.

Then, as illustrated in FIG. 3, the segmental pictures 515A, 515B are displayed separately on respective cards 504 of the two stacks 501. For example, when the segmental picture 515A is displayed on the front side (on the top side in FIG. 1) of a card 504 on one stack 501, the segmental picture 515B is displayed on the back side (on the bottom side in FIG. 1) of a card 504 on the other stack 501. Similarly, segmental pictures, divided from respective overall pictures, are displayed on other cards 504 of the respective stacks 501 as other correct combinations.

This puzzle is played in such a manner that a player turns over cards 504, each displaying a segmental picture, one by one to select and expose a segmental picture required for a correct combination from a plurality of cards 504 belonging to each of the stacks 501, and combines the selected segmental pictures of the respective stacks 501 in close proximity to reconstruct an overall picture over the two combined cards 504 as the correct combination of the puzzle.

Each of the cards 504 also displays reconstruction information for helping a player reconstruct the aforementioned overall picture. In this embodiment, as the information for helping a player reconstruct the overall picture 515 of the cat, the cards 504 belonging to the respective stacks 501, respectively displaying the segmental pictures 515A, 515B, each display, for example, a letter "C" 517 or 518, which is the initial letter of "cat." In this event, the card 504 belonging to one stack 501 may display the letter 517 in a right end region of the segmental picture 515A, while the card 504 belonging to the other stack 501 may display the letter 518 in a left end region of the segmental picture 515B. This manner of displaying the letters 517, 518 on the respective cards 504 helps the player readily reconstruct the overall picture as the correct combination, by approaching both cards with the aid of the letters "C" 517, 518 and combining the segmental pictures 515A, 515B. Similarly, other segmental pictures on the remaining cards 504 are each assigned a letter associated therewith as reconstruction information.

The puzzle having the structure as described above may be played in the following manner. First, the two stacks 501 are placed, for example, on a desk side by side with all cards 504 collected on one side, as illustrated in FIG. 1. Next, as the player turns over cards 504 of one stack 501 one by one, the player eventually selects a card 504 displaying the segmental picture 515A of the cat, and exposes the segmental picture 515A. Further, the player similarly turns over cards 504 of the other stack 501 one by one until the segmental picture 515B of the cat is encountered, and selects and exposes the segmental picture 515B when the player thinks that the correct combination will be reached if the segmental picture 515B is combined with the segmental picture 515A.

Figure 4:
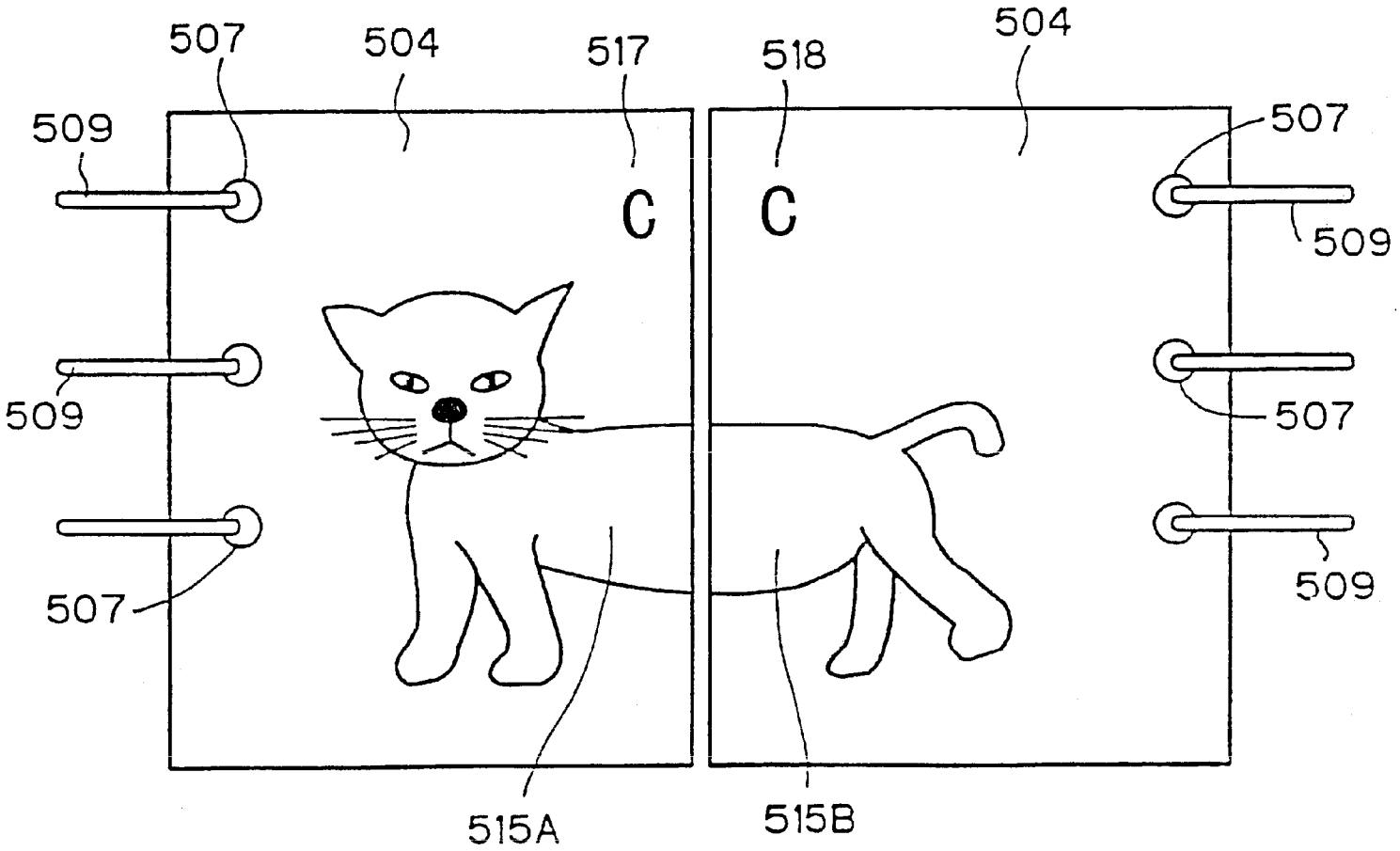
FIG. 4 is a top plan view illustrating two stacks of the first embodiment placed in close proximity.

Cards not selected in either of the stacks 501 may be placed on the bottom. Then, as illustrated in FIG. 4, when the two cards 504 of the respective stacks 501 are brought into close proximity, the segmental pictures 515A, 515B match to reconstruct the overall picture 515 of the cat as the correct combination. Similarly, a different overall picture can be reconstructed from other cards 504 as another correct combination.

If the player experiences difficulties in the reconstruction of the overall picture as the correct combination only by turning over the cards 504 to view segmental pictures thereon, the player may turn over the cards 504 relying on letters serving as reconstruction information, for example, the letters "C" 517, 518. The player can eventually reach the overall picture 515 of the cat as the correct combination or goal by placing the letters "C" 517, 518 in close proximity to each other, as illustrated in FIG. 4.

As described above, with the puzzle of this embodiment, the player takes pleasure in finding a variety of correct combinations while viewing segmental pictures or reconstruction information from a plurality of the cards 504. When the player leaves off the puzzle, the stacks of cards 504 may be placed one on top of the other so that the entire puzzle can be reduced in size and therefore provide a good portability.

Also, in this puzzle, since the cards 504 are bound by the holders 509, the player can readily match two cards 504 even in a joggling vehicle or the like. In addition, the cards 504 bound by the holders 509 eliminate the effort of confirming whether any card is missing. Further, during carrying, using, keeping the puzzle, cards 504 will not be dispersed or lost. Moreover, since a plurality of holders 509 are used, the cards 504 are always stacked with the four sides thereof aligned, when they are turned over, so that the player can smoothly view one segmental picture to another and instantaneously recognize the picture in an attempt of selecting a segmental picture and matching selected segmental pictures to reconstruct an overall picture.

Figure 5:
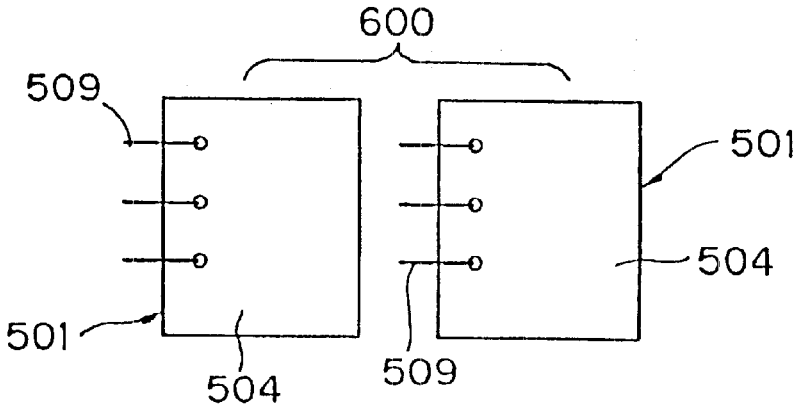
FIG. 5 is a top plan view illustrating a second embodiment of the puzzle according to the present invention.
Figure 5:
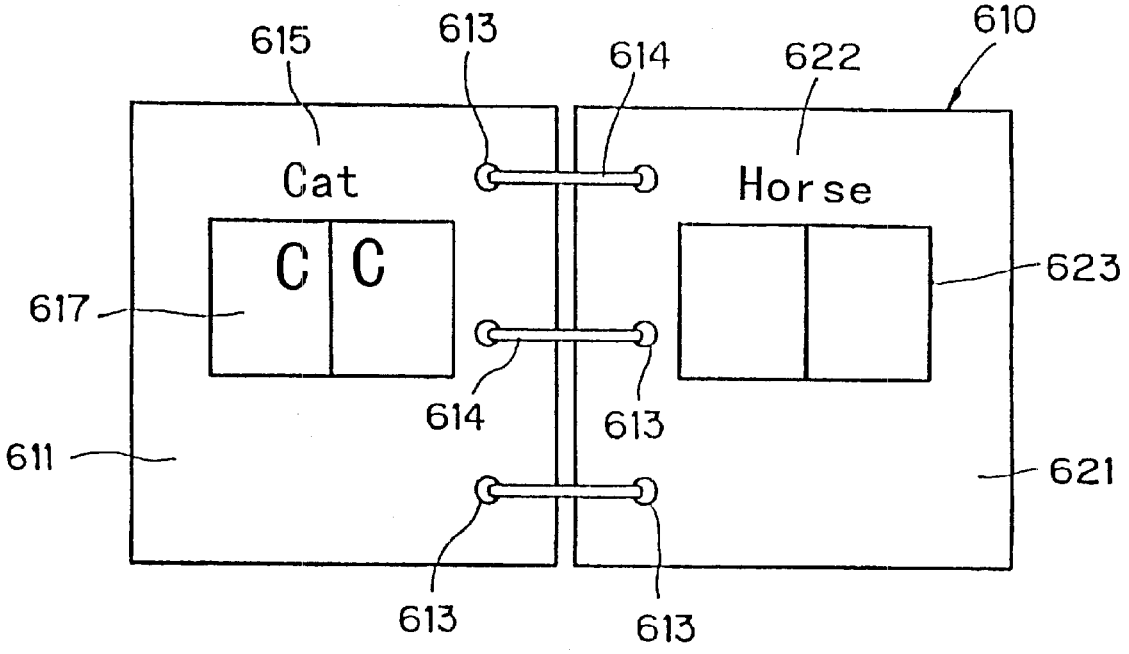

Next, a second embodiment of the puzzle according to the present invention will be described with reference to FIG. 5. The puzzle of this embodiment has a puzzle body 600 comprised of a combination of two stacks 501 such as those of the first embodiment (illustrated in a reduced scale for convenience in FIG. 5), and a reconstruction information stack 610 for reconstructing an overall picture as a correct combination. As illustrated in FIG. 5, the reconstruction information stack 610 is comprised of a plurality of cards that include two types of different cards: information display cards 611 on which reconstruction information has been previously provided, and information registration cards 621 on which the player can write reconstruction information when he himself has found a correct combination. The cards 611, 621 are stacked and bound by holders 614 extending through holes 613 formed through the respective cards.

More specifically, the information display card 611 displays a title 615, for example, "CAT" as reconstruction information for an overall picture of the aforementioned cat; and a field 617 for indicating the positions of the letters "C" 517, 518 on respective cards 504 when they are placed in close proximity to combine segmental pictures 515A, 515B for finding a correct combination. Similarly, each of the remaining information display cards 611 displays a similar title and a similar field corresponding to a segmental picture which can be combined into an overall picture as a correct combination. The information registration card 621 displays a title 622 indicative of another overall picture as a correct combination, for example, "HORSE" and a blank field 623 for writing information on how associated segmental pictures should be placed in close proximity.

With the structure described above, if the player cannot find a combination of segmental pictures constituting an overall picture as a correct combination, the player may turn over the information display cards 611 to refer to reproduction information displayed thereon. For example, for obtaining the overall picture 515 of the cat, the player will understand that cards 504 displayed with the letters 517, 518 should be selected and placed side by side when he views the title 615 and the field 617 on the information display card 611. Alternatively, when the player himself turns over the cards 504 and eventually obtains an overall picture as a correct combination without relying on the reference to the reconstruction information stack 610, the player may write in the field 623 of the information registration card 621, reconstruction information displayed on the cards 504, i.e., letters displayed on the cards 504 that display segmental pictures of an overall picture, for example, "H" when the overall picture represents a horse. In this way, the overall picture of the horse can be reconstructed at later time by referencing the information registration card 621.

Figure 6:
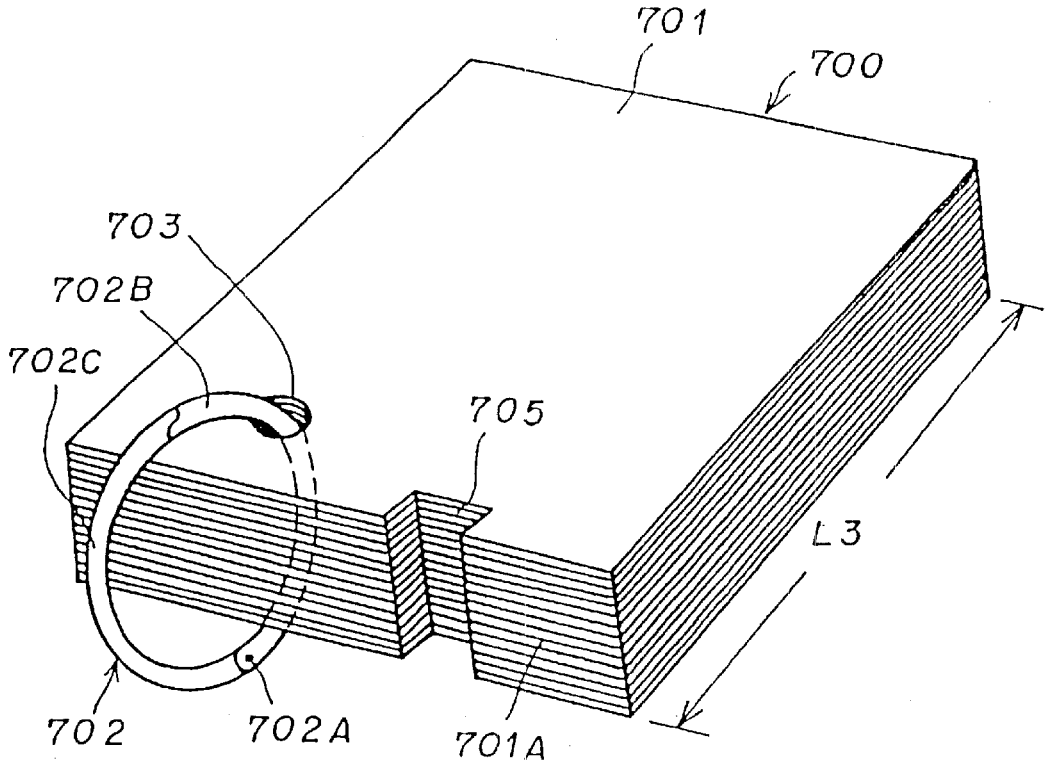
FIG. 6 is a perspective view illustrating a stack forming part of a puzzle according to a third embodiment of the present invention.

Next, a third embodiment of the puzzle according to the present invention will be described with reference to FIGS. 6 to 12. The puzzle is comprised of a plurality of stacks as illustrated in FIG. 6. Since the respective stacks are identical in structure except for the contents displayed on cards belonging thereto, only one of them will be described below (the same shall apply to subsequent embodiments). A stack, generally designated by reference numeral 700, includes a plurality of cards 701 stacked in the vertical direction, and a circular holder 702. The respective cards 701 are formed with holes 703 extending therethrough, such that the holder 702 can pass through the holes 703.

The holder 702 has a fulcrum 702A and arms 702B, 702C which are opened when a card 701 is added or removed from the stack and closed after addition or removal. When the holder 702 is inserted through the holes 703 such that the arm 702B, for example, is placed inside the space defined by the holes 703 of the respective cards 701, the opposite arm 702C is positioned laterally to the stack of cards 701. Each of cards 701 is also formed with a notch 705 on at least one side 701A thereof for accommodating the opposite arm 702C when the holder 702 is rotated about the arm 702B placed within the stack. The notch 705 should be sized to have a width L1 (see FIG. 7) sufficient to accommodate an arcuate portion of the arm 702C and a depth L2 (see FIG. 8) larger than the diameter of the holder 702. The depth of the notch is set in a similar manner in subsequent embodiments.

Each of the cards 701 belonging to the plurality of stacks 700 displays one of a plurality of segmental pictures constituting an overall picture as a correct combination, as is the case with the aforementioned embodiments. Here, four stacks 700 are provided, for example, to create a puzzle for reconstructing an overall picture of a dog by assembling four segmental pictures displayed separately on cards 701 in three stacks.

Figure 9:
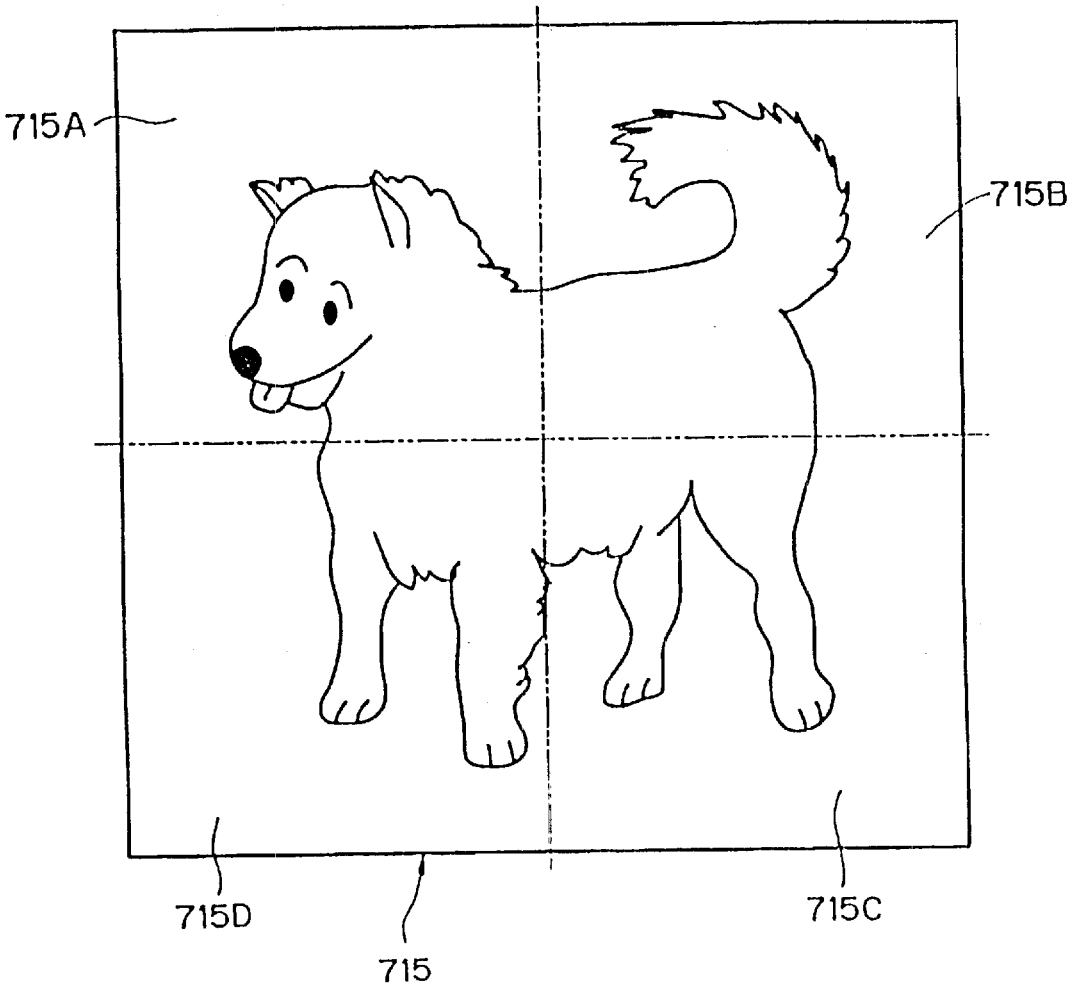
FIG. 9 is a top plan view illustrating an overall picture as a correct combination of the puzzle according to the third embodiment.

FIG. 9 illustrates an overall picture 715 of the dog which is divided into four segmental pictures 715A, 715B, 71C, 715D as indicated by two-dot chain lines. Then, the segmental pictures 715A, 71B, 71C, 715D are distributed to cards 701 of three stacks 700. For example, as illustrated in FIG. 10, the segmental pictures 715A, 71B, 715C, 715D may be distributively displayed in such a manner that the segmental picture 715A is displayed on the first one of the cards 701 belonging to a first stack 700 (FIG. 10A); the segmental picture 715B on the fifth one of the cards 701 belonging to a second stack 700; the segmental picture 715C on the fourth one of the cards 701 belonging to the second stack 700 (see FIG. 10B); and the segmental picture 715D on the first one of the cards 701 belonging to a fourth stack 700 (see FIG. 10C).

Each of the cards 701, displaying a segmental picture, also indicates numbers 720 of three figures as reconstruction information on an associated overall picture, along the respective sides of the card 701 and with their upper parts directed to the respective sides. Explaining how the numbers serve as the reconstruction information, a value on the most significant figure indicates which of the stacks in the puzzle an associated card belongs to; a value op the middle figure indicates where the associated card is positioned in the stack; and a value on the least significant figure indicates the angle or direction in which the card is oriented on the stack, viewed by the player, when an overall picture is reconstructed as a correct combination. In this event, since the cards 701 can be rotated in increments of 90 degrees at four steps, so that numbers from "1" to "4" are assigned in the clockwise direction.

Figure 10A:
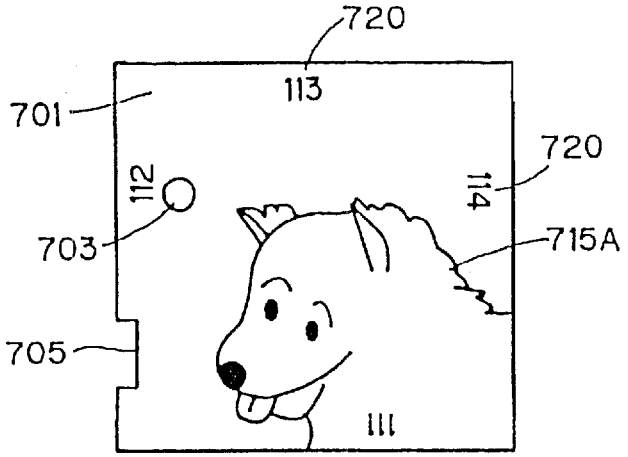
FIGS. 10A to 10C are top plan views illustrating cards used in the puzzle of the third embodiment.
Figure 10B:
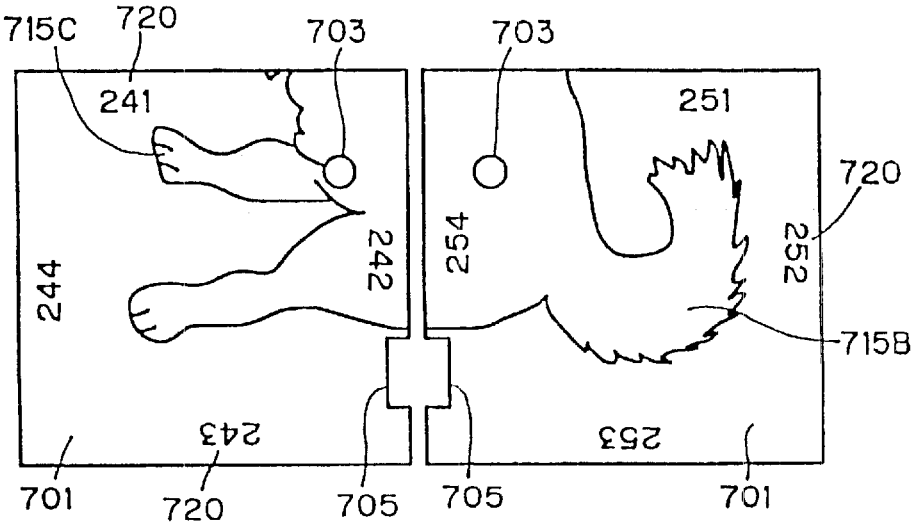
Figure 10C:
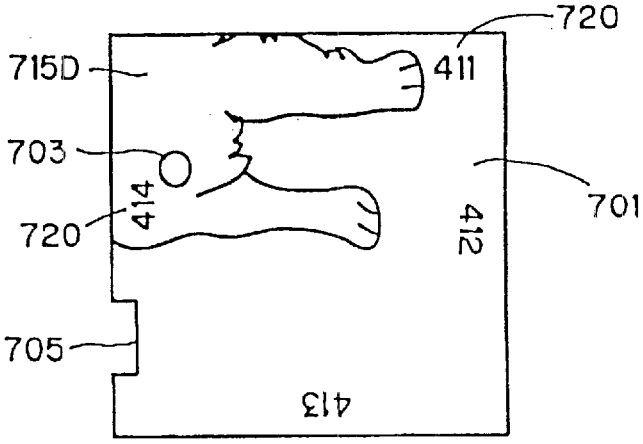

Thus, with reference to the card illustrated in FIG. 10A, by way of example, it is understood from the numbers 111 to 114 written on the card that the card indicates the following state. The values on the most significant figures of the respective numbers 720 set at "1" indicate that the card belongs to the first stack, and the values on the middle figures of the respective numbers 720 set at "1" indicate that the card is positioned on the first page of the stack. Then, the number "113" including the value "1" on the least significant figure is in an upright state because the reconstruction information stack, described below, displays the number "113" as the reconstruction information for a correct combination, so that the card should be oriented such that the dog's face is positioned on the upper side when the overall picture is reconstructed as the correct combination.

The three-digit numbers 720 as mentioned above are displayed along the four sides of each card in an arbitrary manner. For example, in FIG. 10A, any of numbers "111," "112," and "114" may be displayed along the upper side instead of the shown number "113." Accordingly, the number thus displayed is written on the reconstruction information stack.

Figure 11:
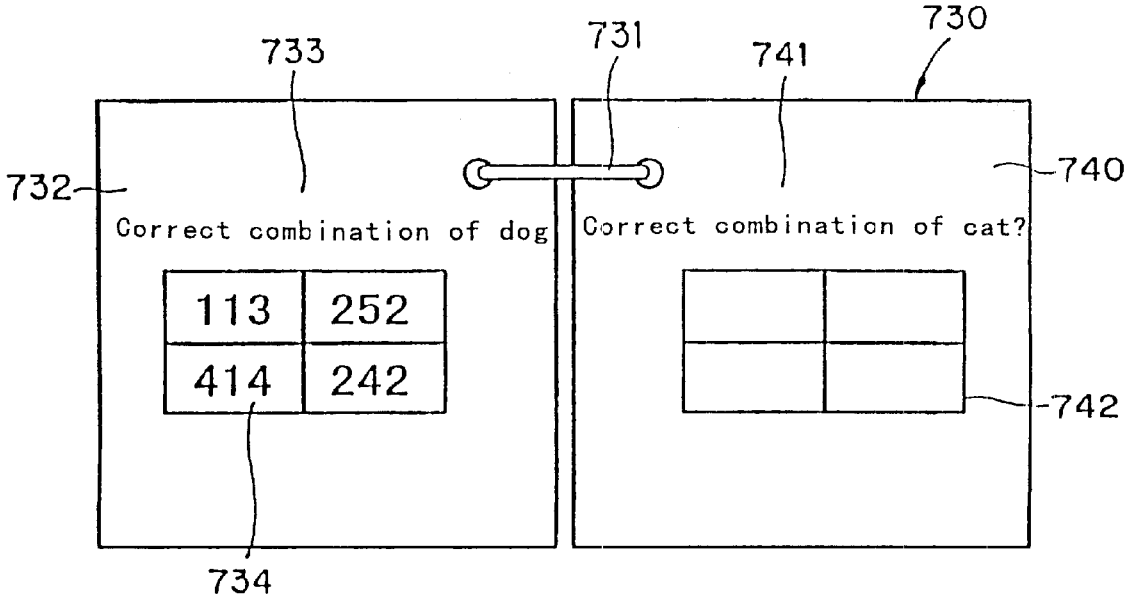
FIG. 11 is a top plan view illustrating a reproduction information stack used in the puzzle of the third embodiment.

As illustrated in FIG. 11, the stack 700 is combined with a reconstruction information stack 730 for displaying reconstruction information on the overall picture 715 of the aforementioned dog and overall pictures as other correct combinations. The reconstruction information stack 730 has a plurality of cards bound by a holder 731, as is the case with the aforementioned second embodiment. One of reconstruction information display cards 732 displays a title 733 "CORRECT COMBINATION OF DOG" and three-digit numbers 734 displayed on cards depicting segmental pictures, including overall pictures other than the dog, which are assembled into the overall picture. The numbers 734 are displayed from the upper left position in the clockwise direction corresponding to the associated cards that are assembled to reconstruct the overall FIG. 715 of the dog in an upright state as illustrated in FIG. 9.

The reconstruction information stack 730 also has information registration cards 740 as illustrated in FIG. 11. For example, if an overall picture of a cat is included as another correct combination, a card 740 displays a title 741 "CORRECT COMBINATION OF CAT?" and a blank field 742 for filling four three-digit numbers as reconstruction information.

Next, with the puzzle comprised of the four stacks in combination, a procedure of reconstructing the overall picture of the dog as the correct combination will be described with reference again to FIG. 10. When the holder 702 is removed from the notch 705 as illustrated in FIG. 6, the player can turn over cards 701 along the holder 702 as desired.

First, on the first stack, as the segmental picture 715A showing the face of the dog appears on the first card as illustrated in FIG. 10A, the player selects this card. Next, as cards of the second stack are turned over one by one, the segmental picture 715C showing a rear leg of the dog appears on the fourth card, and is therefore selected. On the next fifth card, the segmental picture 715B showing the tail of the dog appears and therefore is selected, with the result that the segmental pictures 715B, 715C are combined over two cards 701 in the second stack, as illustrated in FIG. 10B. Next, cards of the third stack, not shown, are turned over without finding any segmental picture leading to the correct combination, so that the fourth stack is taken. As illustrated in FIG. 10C, the segmental picture 715D showing the forelegs of the dog is found on the first card which is therefore selected.

Figure 12:
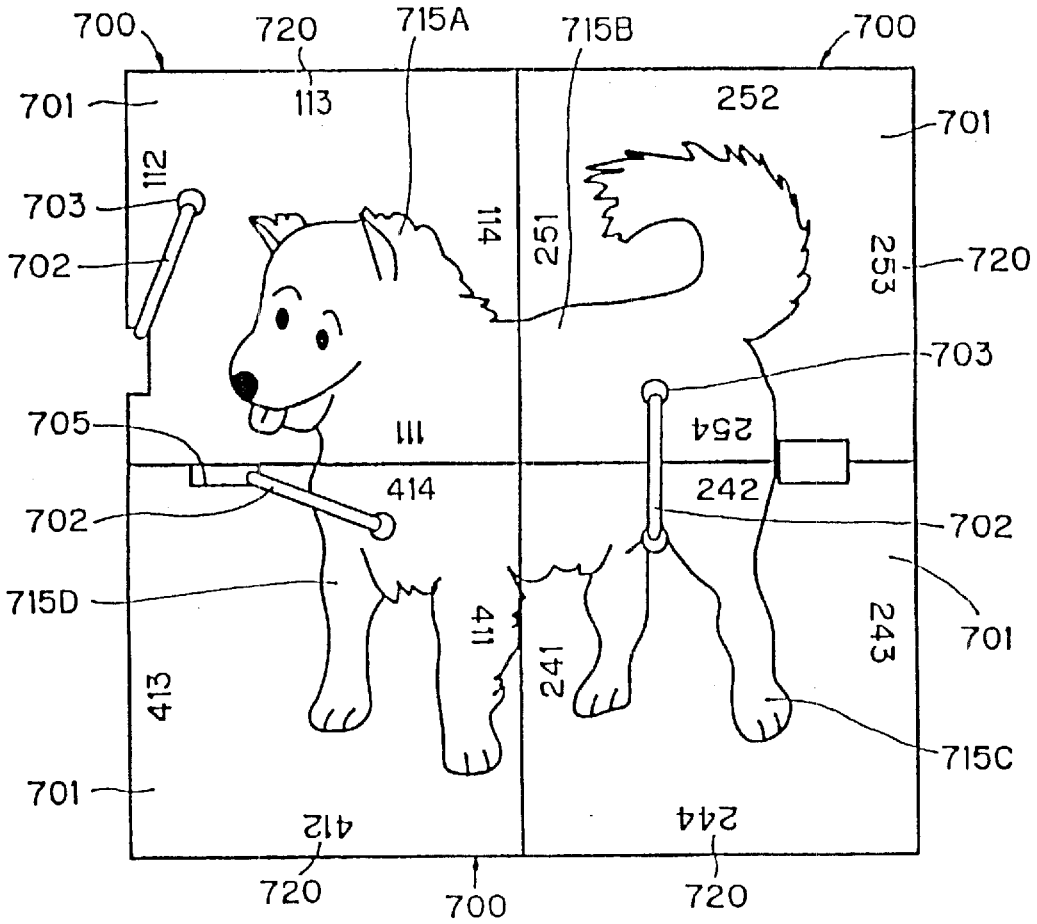
FIG. 12 is a top plan view illustrating stacks of the puzzle when a correct combination is reached in the third embodiment.

Next, with the four segmental pictures 715A to 715D left exposed, the respective stacks 700 are rotated as required and placed in close proximity to reconstruct the overall picture 715 of the dog as the correct combination, as illustrated in FIG. 12. In this event, the holder 702 exists between adjacent stacks 700 such as that between the stack 700 displaying the segmental picture 715A and the stack 700 displaying the segmental picture 715D, in which case, the holder 702 can be retracted into the notch 705. It is therefore possible to bring adjacent sides of the two stacks 700 into close contact to seamlessly reconstruct the overall picture across the two stacks 700 in a continuous manner.

While a correct combination can be found by turning over cards of each stack 700 and viewing only segmental pictures thereon, the reconstruction information stack may be used in combination, as described below. For example, for finding the overall picture 715 of the dog, the player may refer to a card 732 which displays "CORRECT COMBINATION OF DOG" as the title 733 in the reconstruction information stack. As previously mentioned, since the card 732 indicates the three-digit numbers 734 "113," "252," "242," "414" from the upper left position in the clockwise direction, the player may turn over cards of the respective stacks 700 in accordance with the displayed numbers in the following manner.

First, the first card 701 of the first stack 700 is selected in accordance with the number "113," followed by placing the stack 700 at an angle so that the number "113" is located on the upper side. Next, the fourth card of the second stack 700 is selected in accordance with the number "242," followed by placing the stack 700 at an angle so that the number "242" is located on the upper side. Similarly, the fifth card 701 of the same second stack 700 is selected in accordance with the number "252." Since the segmental picture on the fifth card is continuous to the segmental picture on the preceding fourth card, the fifth card is left as it is. Then, the first card of the fourth stack 700 is selected in accordance with the number "414," followed by placing the stack 700 at an angle so that the number "414" is located on the upper side. Finally, as the three stacks are placed in close proximity, the overall picture 715 of the dog is completed as the correct combination as illustrated in FIG. 12.

When cards of the respective stacks are turned over one by one to find segmental pictures which are successfully assembled into an overall picture of a cat, not shown, as another correct combination, three-digit numbers on the cards of the four segmental pictures are filled in the blank field 742 of an information registration card 740. In this way, even if the player fails to find the correct combination of the cat in the next play with the puzzle, the player can reconstruct the overall picture as the correct combination by referring to the numbers.

Figure 7:
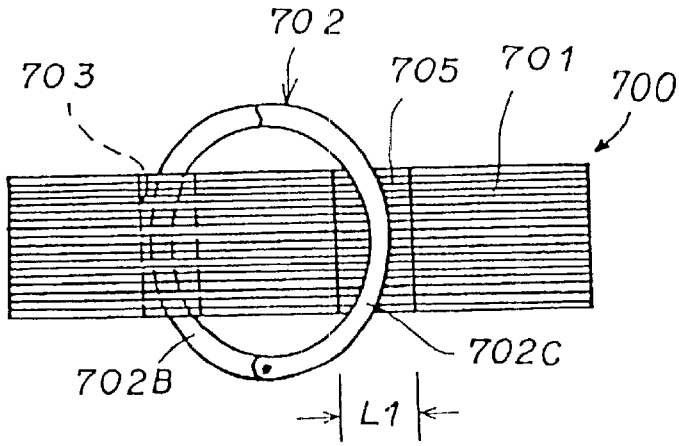
FIG. 7 is a front view illustrating the stack of the third embodiment when it is accommodated in a box.
Figure 8:
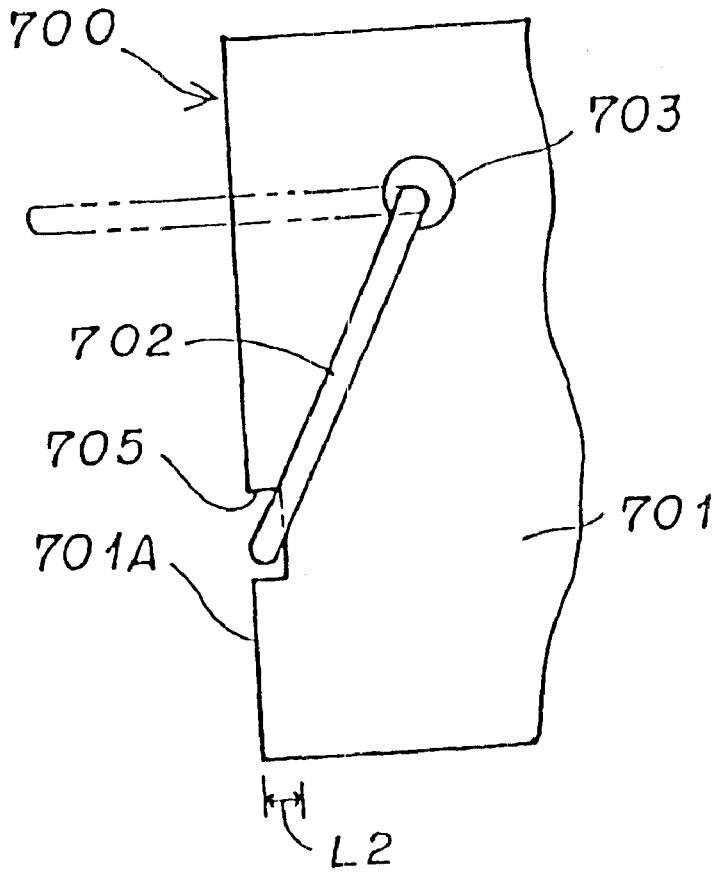
FIG. 8 is a partial top plan view showing from the above the state illustrated in FIG. 7.

With the puzzle constructed as described above, when cards 701 are stacked in group, and the holder 702 is swung about a portion thereof inserted in the cards 701 to introduce the opposite arm into the notch 705 as illustrated in FIGS. 7 and 8, the opposite arm of the holder 702 is fitted in the notch 705 so that the sides 701A of the cards 701 are stopped by the holder 702. Therefore, even if the cards 701 are flapped by the wind, the cards 701 will not be turned over. In addition, since the portion of the holder 702 fitted in the notch 705 does not protrude from the sides 701A of the cards 701, the stack 700 can be conveniently accommodated for keeping or the like in a box which has a width coincident with the width of the cards 701 (the dimension L3 in FIG. 6).

Figure 13:
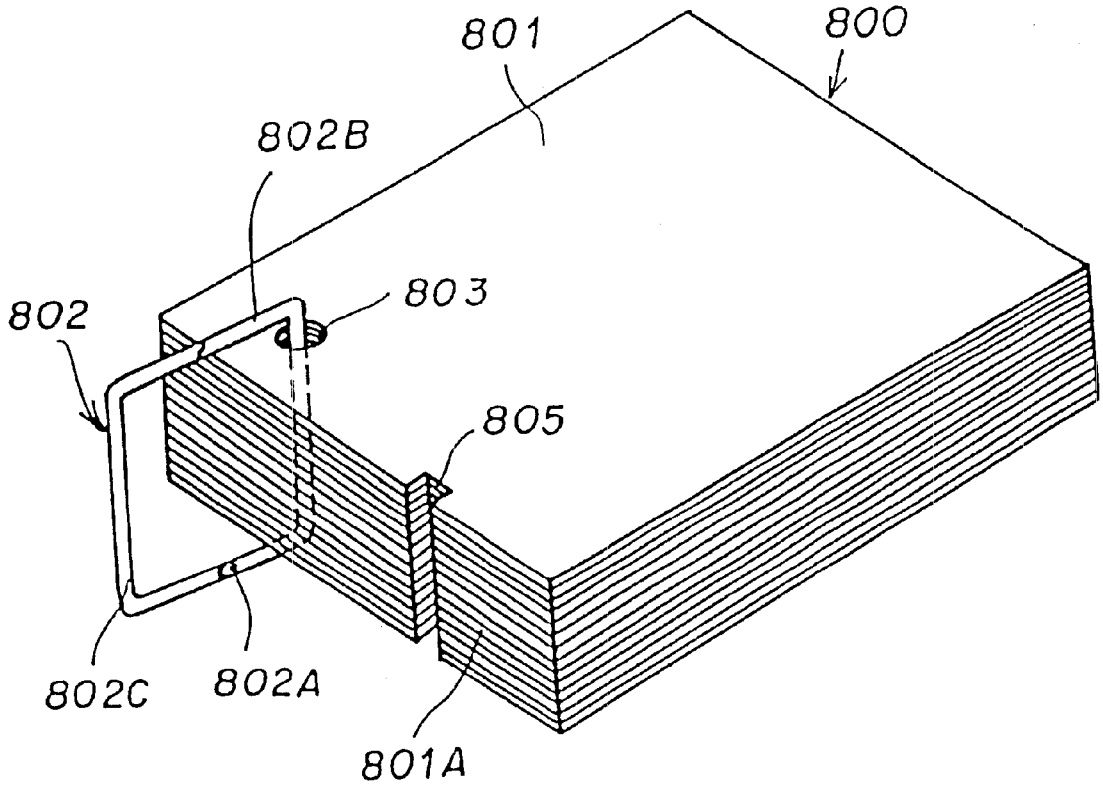
FIG. 13 is a perspective view illustrating a stack forming part of a puzzle according to a fourth embodiment of the present invention.
Figure 14:
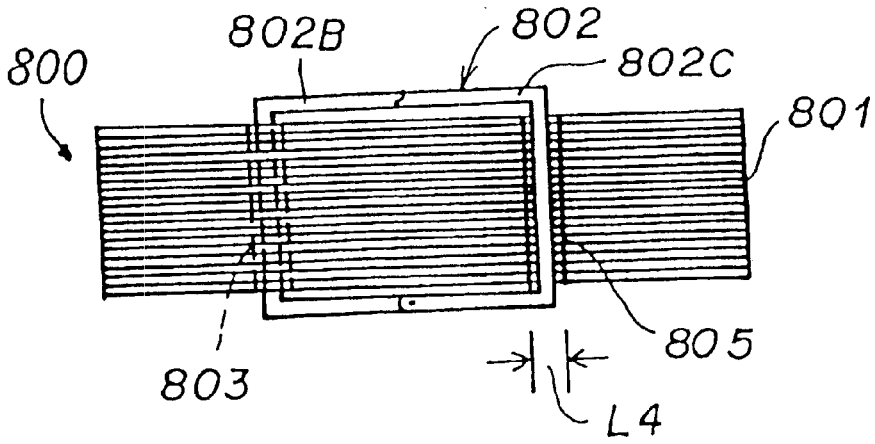
FIG. 14 is a front view illustrating the stack of FIG. 13 when it is accommodated in a box in the fourth embodiment.

Next, a fourth embodiment of the puzzle according to the present invention will be described with reference to FIGS. 13 and 14. The puzzle of this embodiment is comprised of a plurality of stacks 800 as illustrated in FIGS. 13 and 14 in combination. The stack 800 comprises a plurality of cards 801, each of which displays a segmental picture as described above thereon, and a rectangular holder 802. Each of the cards 801 is formed with a hole 803 through which the holder 802 can be inserted. The holder 802 includes a fulcrum 802A and a C-shaped and in inverted C-shaped arms 802B, 802C. In addition, each of the cards 801 is formed with a notch 805 on at least one of the sides 801A, such that when one arm of the holder 802, for example, 802B, is inserted through the holes 803 of the cards 801 and left therein, the arm 802C opposite to the arm 802B can be introduced into the notch 805. The width L4 of the notch 805 may be equal to or larger than the thickness of the holder 802.

According to the fourth embodiment, since the holder 802 is rectangular in shape and accordingly free from an arcuate bulge as a circular holder, the holder 802 extends in parallel with the surface of the cards 801 as illustrated in FIG. 14. Thus, when the puzzle is accommodated in a box as previously mentioned in the third embodiment, the box can be reduced in thickness, i.e., the vertical dimension.

Figure 15:
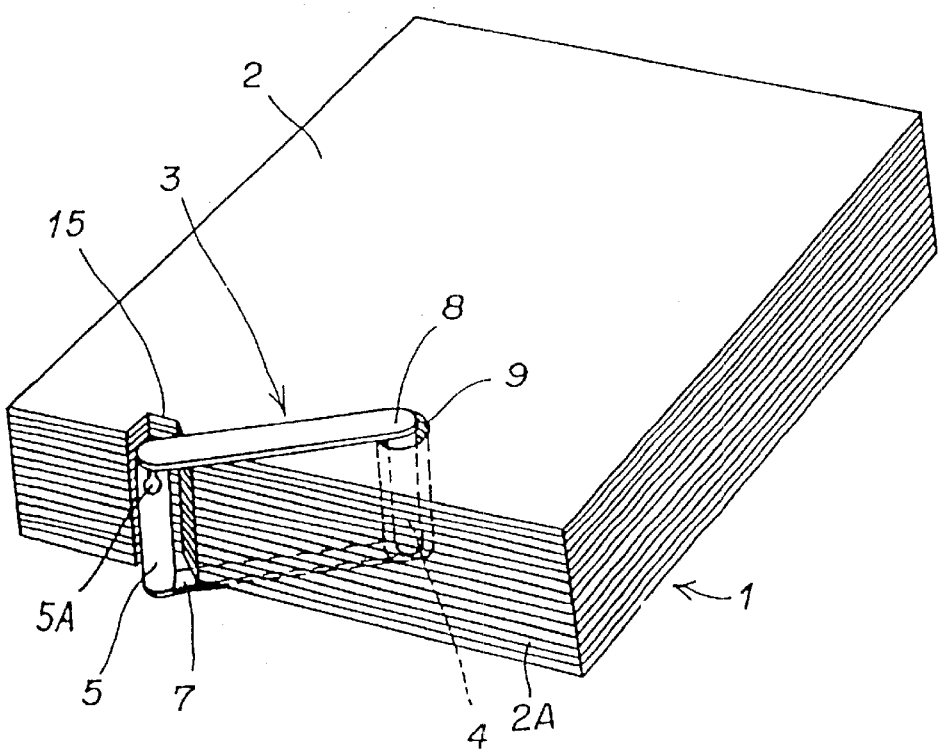
FIG. 15 is a perspective view illustrating a stack forming part of a puzzle according to a fifth embodiment of the present invention.

Next, a fifth embodiment of the puzzle according to the present invention will be described with reference to FIGS. 15 to 24. The puzzle of this embodiment is comprised of a plurality of stacks as illustrated in FIG. 15 in combination. The stack, generally designated by reference numeral 1, comprises a plurality of cards 2 stacked in the vertical direction, and a holder 3 in the form of quadrilateral, as illustrated in FIG. 15. Each card 2 displays a segmental picture as previously described. The holder 3 is formed in a quadrilateral consisting of a pair of vertical rods 4, 5 and a pair of horizontal rods 7, 8.

The pair of vertical rods 4, 5 are cylinder, and one vertical rod 4 extends through a hole 9 formed vertically through the stack of cards 2, while the other vertical rod 5 is in parallel with the one vertical rod 4. At least one of the pair of horizontal rods 7, 8, which forms the base, i.e., the horizontal rod 7 is connected at right angle with the lower ends of the respective vertical rods 4, 5. While FIG. 15 illustrates that the one vertical rod 4 extends through the hole 9 of the cards 2, the other vertical rod 5 may extend through the hole 9 instead.

Figure 16:
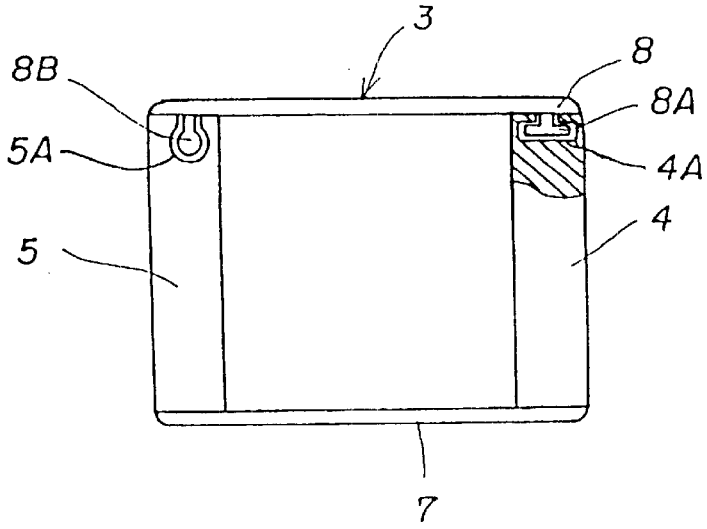
FIG. 16 is a partially cross-sectional front view of a holder in the fifth embodiment.
Figure 17:
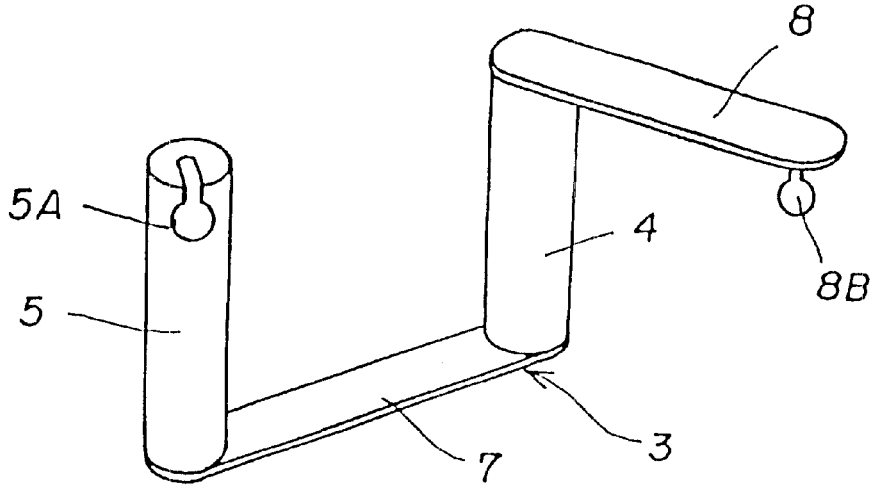
FIG. 17 is a perspective view illustrating the holder, when in use, of the fifth embodiment.

The structure of the holder 3 will be described below in greater detail. The horizontal rods 7, 8 are made of thin plate, the width of which does not exceed the diameter of the vertical rods 4, 5, and are joined to the vertical rods 4, 5 such that its thickness direction is in parallel with the lengthwise direction of the vertical rods 4, 5. Further, as illustrated in FIGS. 16 and 17, the vertical rod 4 is formed at its head with a recess 4A for rotatably supporting a fulcrum salient 8A formed at one end of the horizontal rod 8. The other vertical rod 5 is formed at its head with a recess 5A for removably holding a salient 88 formed at the other end of the horizontal rod 8. The salient 8B comes off from the recess 5A as the horizontal rod 8 is rotated as illustrated in FIG. 17, whereby the quadrilateral holder 3 is opened between the horizontal rod 8 and the vertical rod 5.

As to the salient 8B and the recess 5A, both or one of the rods may be magnetized, or made of a synthetic resin, rubber or woody material, or combined with such a material to provide an appropriate frictional force, such that an appropriate resistance may be given to opening/closing actions of the horizontal rod 8 to prevent the salient 8B from inadvertently coming off from the recess 5A. The upper horizontal rod 8 is also formed of a thin plate similar to that used for the lower horizontal rod 7.

Figure 18:
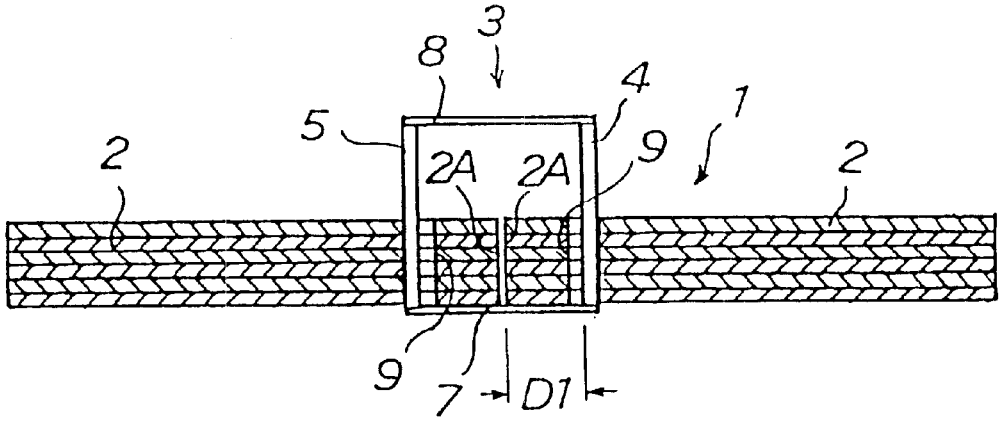
FIG. 18 is a partially cross-sectional front view illustrating a state in which cards have been moved from one side to the other in the fifth embodiment.
Figure 19:
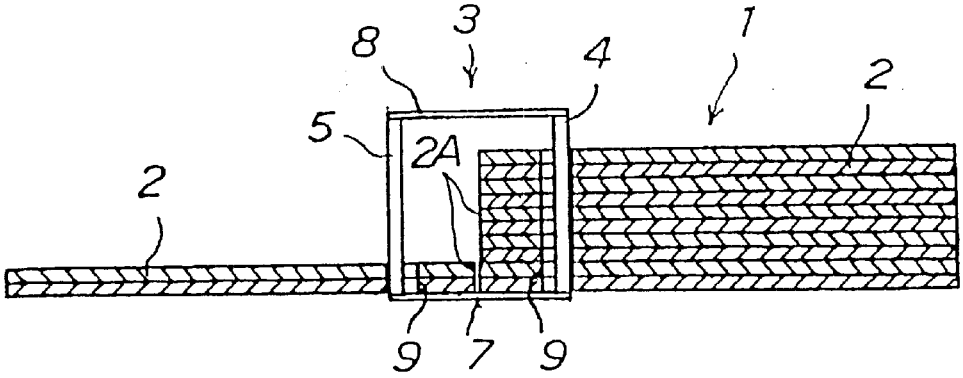
FIG. 19 is a partially cross-sectional front view illustrating another state in which cards have been moved from one side to the other in the fifth embodiment.

The hole 9 formed through each card 2 for inserting the vertical rod 4 of the holder 3 therethrough may be located at the following position. Referring to FIGS. 18 and 19, cards 2 stacked along the vertical rod 4 can be turned over and moved through the horizontal rod 8 of the holder 3 to the other vertical rod 5. In this event, cards 2 passed through by the vertical rods 4, 5 have the respective sides 2A opposite to each other. FIG. 18 illustrates that both the cards 2 stacked along the vertical rods 4, 5 are equal in number, while FIG. 19 illustrates that they are different in number.

Figure 20:
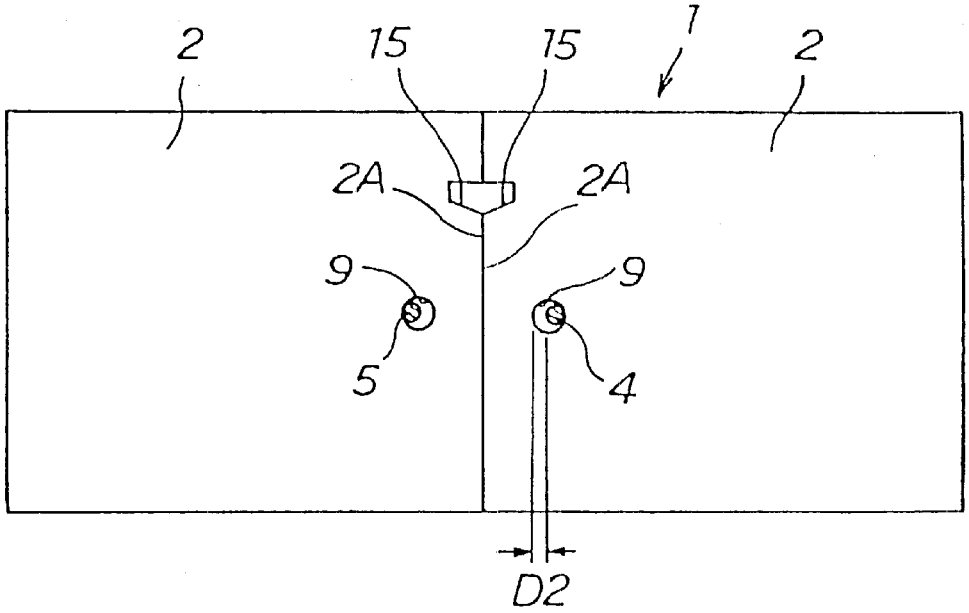
FIG. 20 is a top plan view illustrating that a card of a stack is turned over in the fifth embodiment.

The hole 9 may be located such that a segmental picture displayed on one card 2 placed on the one vertical rod 4 side and a segmental picture displayed on a card 2 moved to the other rod 5 appear in one piece, when viewed from a direction perpendicular to the card 2, i.e., from the above of the drawing. In other words, the length of the horizontal rods 7, 8 are set substantially double the distance D1 from the hole 9 of the card 2 to the side 2A. The hole 9 may be formed slightly larger than the outer diameter of the vertical rods 4, 5 to provide a clearance D2, as illustrated in FIG. 20, so that the card 2 can be smoothly moved.

The side 2A of each card 2 is formed with a notch 15 in which the other vertical rod 5 is fitted, as illustrated in FIG. 15. The notch 15 may be located at a position to which the vertical rod 5 abuts when the holder 3 is rotated about the one vertical rod 4.

Figure 21:
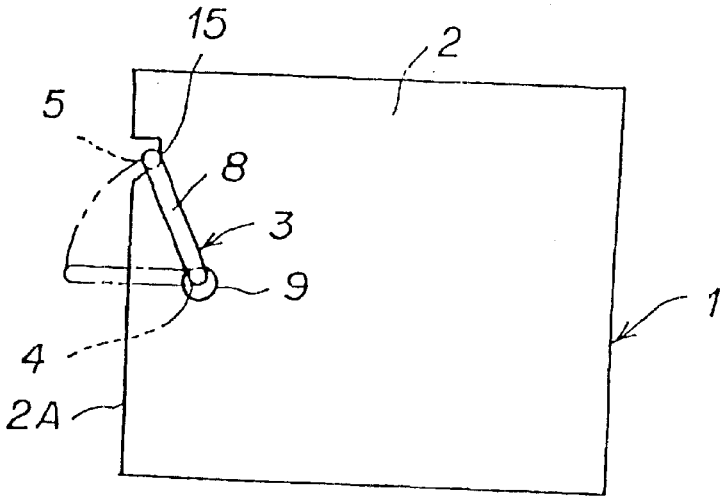
FIG. 21 is a top plan view illustrating a holder fitted in a notch in the fifth embodiment.

According to the fifth embodiment, the stack 1 before use is such that the cards 2 are stacked along the vertical rod 4 with the vertical rod 5 of the holder 3 fitted in the notch 15, as illustrated in FIG. 21. With such a state, the cards 2 are supported by the horizontal rod 8 on the side 2A, so that the cards would not be flapped and turned over by the wind, if any. When the stack 1 is used, the holder 3 is rotated in the counterclockwise direction in FIG. 21 to draw out the vertical rod 5 from the notch 15, such that the horizontal rods 7, 8 are perpendicular to the sides 2A of the cards 2, as indicated by two-dot chain lines in FIG. 21.

Figure 22:
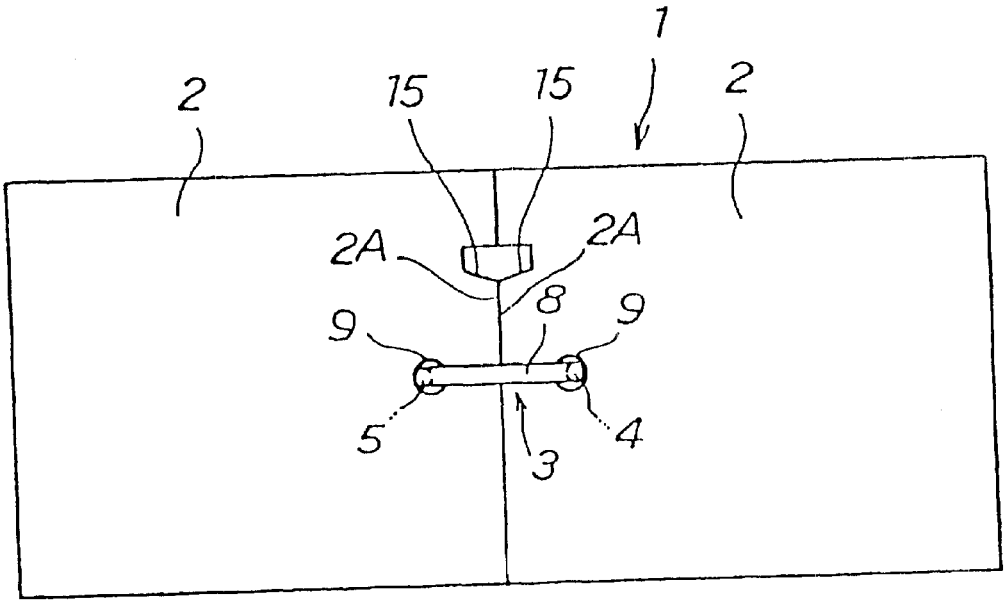
FIG. 22 is a top plan view illustrating a stack in a used state in the fifth embodiment.

In the state mentioned above, the top card 2 on the vertical rod 4 side is turned over and moved to the vertical rod 5 side. The respective sides 2A of the cards 2 on both rod sides are brought into contact when the cards on both sides are equal in number, so that segmental pictures displayed on the two cards 2 appear to be one picture as illustrated in FIG. 22. In addition, even if the top cards 2 on both sides are different in height as illustrated in FIG. 19 so that they are not directly in contact with each other, segmental pictures on the two cards 2 appear to be continuous when viewed from the above of the drawing. Since the lower horizontal rod 7 is made in a plate-like form, the stack 1 can be placed in close contact with a planar surface of a desk or the like, without causing substantially any difference in level, thereby preventing the stacked cards 2 from rising to damage the continuity between two segmental pictures.

Figure 23:
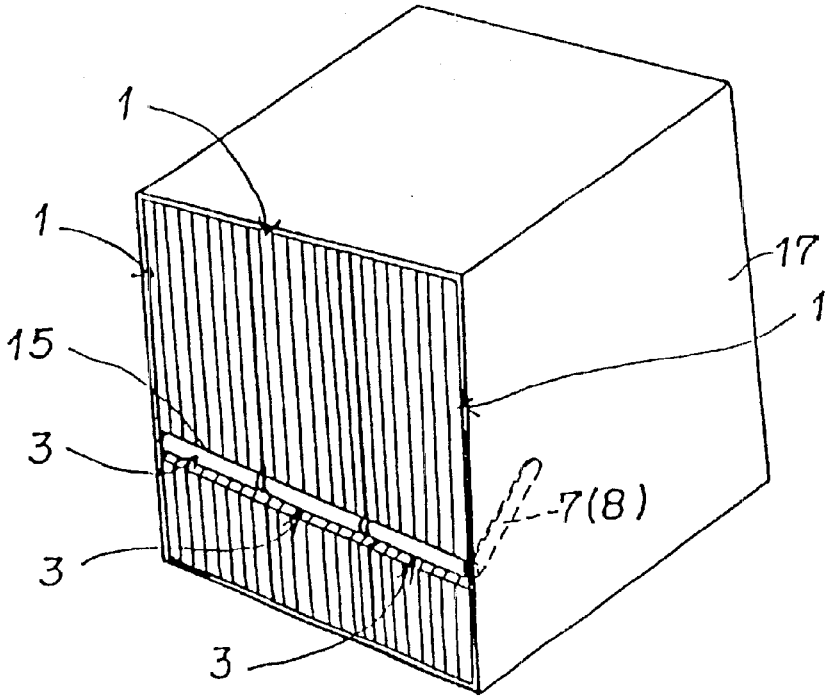
FIG. 23 is a perspective view illustrating a stack of FIG. 15 when it is accommodated in a box in the fifth embodiment.

With the stack 1 described above, the horizontal rod 8 of the holder 3 may be rotated to open the holder 3 between the horizontal rod 8 and the vertical rod 5, as illustrated in FIG. 17, to add, remove, and/or exchange the cards. The stack 1 may be accommodated in a box 17 before use or after use as illustrated in FIG. 23, in which case, the holder 3 is shaped as mentioned above and the vertical rod 5 is fitted in the notch 15 of the cards 2, so that the holder 3 will never protrude from the box 17 or catch a human body to cause damages thereto.

Figure 24:
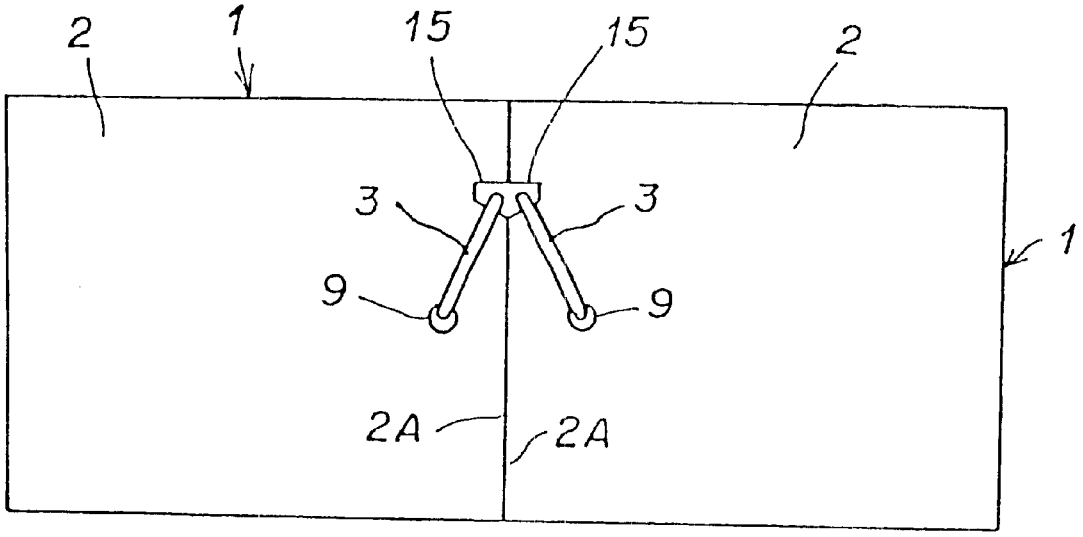
FIG. 24 is a top plan view illustrating the stack in another used state in the fifth embodiment.

Further, when two sets of stacks 1, for example, are provided as components of the puzzle for use in a side-by-side arrangement as illustrated in FIG. 24, the holders 3 of the two stacks may be fitted in the respective notches 15 to prevent interventions of one holder with the other and accordingly an interstice between the sides 2A of the cards 2 of the two stacks 1, so that segmental pictures on two cards on the two stacks 1 can be viewed in one piece.

Figure 25:
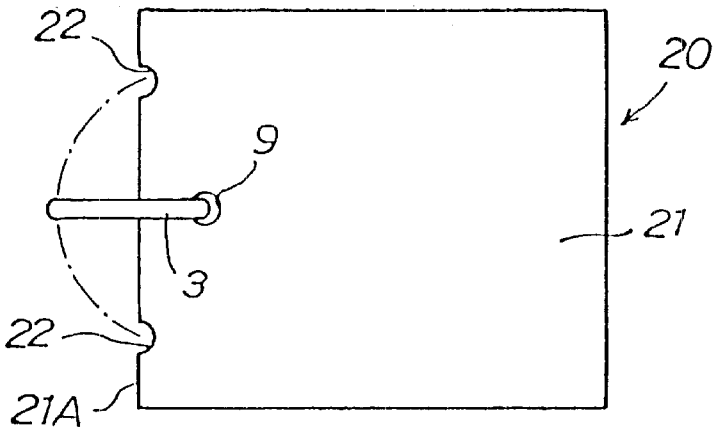
FIG. 25 is a top plan view illustrating a stack forming part of a puzzle according to a sixth embodiment of the present invention.

Next, a sixth embodiment of the puzzle according to the present invention will be described with reference to FIG. 25. The puzzle of this embodiment is comprised of a plurality of stacks as illustrated in FIG. 25 in combination. Each of cards 21 constituting a stack 20 is formed with a hole 9 and a notch 22 as mentioned above, and is further formed with an additional notch 22 at a position of a side 21A symmetric to the notch 22 with respect to the hole 9 for fitting a vertical rod of a holder 3. Each card 21 displays a segmental picture as mentioned above.

With the formation of two notches, the vertical rod of the holder 3 may be fitted in either of the two notches 22, thereby improving the usability of the puzzle.

Figure 26:
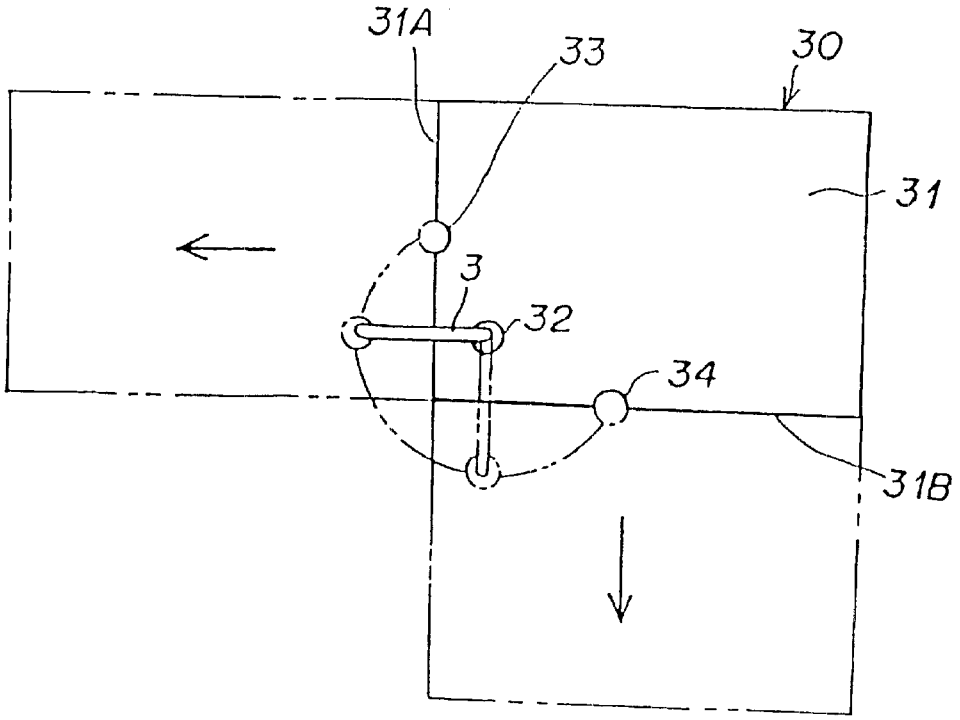
FIG. 26 is a top plan view illustrating a stack forming part of a puzzle according to a seventh embodiment of the present invention.

Next, a seventh embodiment of the puzzle according to the present invention will be described with reference to FIG. 26. The puzzle of this embodiment is comprised of a plurality of stacks as illustrated in FIG. 26 in combination. Each of cards 31 belonging to the stack 30 is formed with a hole 32, through which a holder 3 is inserted, at a position at which a vertical rod 5 of the holder 3 can be pivoted to move a card 31 to one of two directions indicated by arrows in FIG. 26. In either of the two directions, resultant segmental pictures displayed on two opposing cards 31 appear to be one picture. In other words, the hole 32 is located at an equal distance from the two adjacent sides 31A, 31B. The sides 31A, 31B are additionally formed with notches 33, 34, respectively, for fitting the vertical rod 5 of the holder 3 therein.

According to the seventh embodiment, the direction in which the card 31 is turned over can be changed as required in such a manner that the card 31 can be turned over to the left in FIG. 26 when the holder 3 is positioned perpendicular to the side 31A of the card 31, and the card 31 can be turned over downwardly in FIG. 26 when the holder 3 is positioned perpendicular to the side 31B of the card 31. Thus, the stack 30 is particularly suitable for use as a component of a figure matching puzzle. It should be noted that when a plurality of the stacks 30 are provided for use in a side-by-side arrangement, or when they are accommodated in a box, the vertical rod 5 of the holder 3 may be fitted in the notch 33 or 34 as appropriate.

Figure 27:
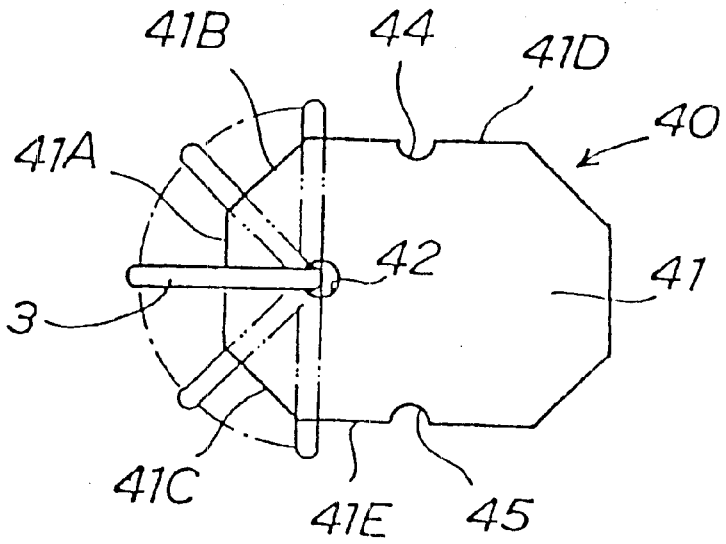
FIG. 27 is a top plan view illustrating a stack forming part of a puzzle according to an eighth embodiment of the present invention.

Next, an eighth embodiment of the puzzle according to the present invention will be described with reference to FIG. 27. The puzzle of this embodiment is comprised of a plurality of stacks 40 as illustrated in FIG. 27 in combination. Cards 41 of the stack 40 is formed in an octagonal shape, and are each formed with a hole 42, through which a holder 3 is inserted, at a position at which a vertical rod 5 of the holder 3 can be pivoted to move a card 41 to one of five directions as indicated by two-dot chain lines in FIG. 27. In any of the five directions, resultant segmental pictures displayed on two opposing cards 41 appear to be one picture. In other words, the hole 42 is located at an equal distance from the five adjacent sides 41A, 41B, 41C, 41D, 41E in the normal direction (right angle direction). Notches 44, 45 for fitting the vertical rod 5 of the holder 3 therein are formed at symmetric positions of the sides 41D, 41E adjacent to the sides 41B, 41C, respectively.

In this way, as the holder 3 is positioned perpendicular to any of the five sides 41A, 41B, 41C, 41D, 41E of the card 41, the card 41 can be turned over in any of the five directions, thereby making it possible to create a wider variety of combinations of segmental pictures as components of the puzzle.

Figure 28:
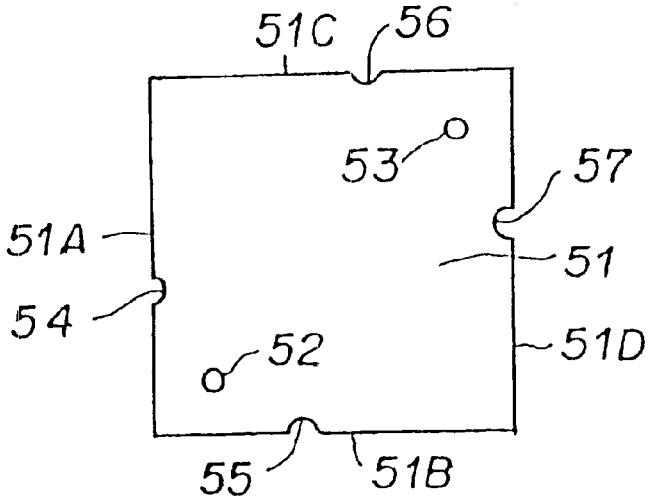
FIG. 28 is a top plan view illustrating a stack forming part of a puzzle according to a ninth embodiment of the present invention.

Next, a ninth embodiment of the puzzle according to the present invention will be described with reference to FIGS. 28 and 29. The puzzle of this embodiment is comprised of a plurality of stacks as illustrated in FIG. 28 in combination. Each of quadrilateral cards 51 constituting the stack is formed with two holes 52, 53, through which a holder 3 is inserted, at two positions on a diagonal line. These holes 52, 53 are located at appropriate positions such that when a vertical rod 5 of the holder 3 is pivoted about the other vertical rod 4 extending through the hole 52 or 53 to move a card 51 in any of two or more directions, resultant segmental pictures displayed on two opposing cards 51 appear to be one picture in any of the direction.

More specifically, the hole 52 is located at an equal distance from the adjacent sides 51A, 51B, while the hole 53 is located at an equal distance from the adjacent sides 51C, 51D, respectively, as has been previously described in the seventh embodiment. In addition, notches 54, 55 are formed associated with the hole 52 on the sides 51A, 51B, respectively, for fitting the vertical rod 5 of the holder 3 therein, while notches 56, 57 are formed associated with the hole 53 on the side 51C, 51D, respectively, for fitting the vertical rod 5 therein.

Figure 29:
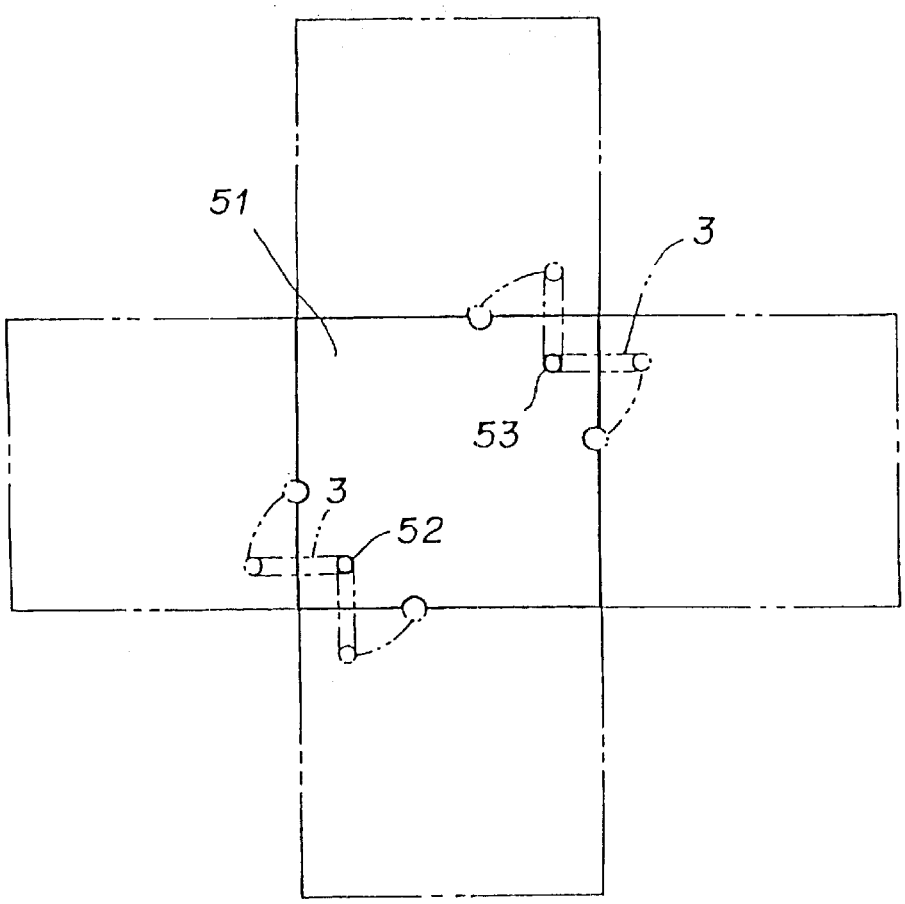
FIG. 29 is a top plan view illustrating stacks of a puzzle according to a tenth embodiment of the present invention when they are in use.

Thus, as illustrated in FIG. 29, when the holder 3 is inserted through, for example, the hole 52, the card 51 can be turned over in the left direction or in the downward direction in the drawing, and when the holder 3 is inserted through the other hole 53, the card 51 can be turned over in the right direction or in the upward direction, thereby resulting in a wider variety of combinations of segmental pictures.

Figure 30:
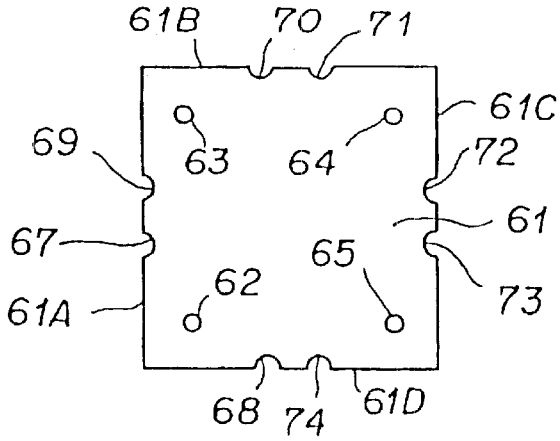
FIG. 30 is a top plan view illustrating a card used in the tenth embodiment.

Next, a tenth embodiment of the puzzle according to the present invention will be described with reference to FIGS. 30 and 31. The puzzle of this embodiment is comprised of a plurality of stacks of cards 61 as illustrated in FIG. 30 in combination. Each of the cards 61 constituting the stack is shaped in square, and is formed with four holes 62, 63, 64, 65, through which a holder 3 is inserted, at four positions near the respective corners at an equal distance from the center of the card 61, as can be seen in FIG. 30. These holes 62, 63, 64, 65 are located at appropriate positions such that when a vertical rod 5 of the holder 3 is pivoted about the other vertical rod 4 extending through the hole 62, 63, 64 or 65 to move a card 61 in any of two directions, resultant segmental pictures displayed on two opposing cards 61 appear to be one picture in any of the directions.

Specifically, as is the case with the aforementioned ninth embodiment, the hole 62 is located at an equal distance from the adjacent sides 61A, 61D; the hole 63 is located at an equal distance from the adjacent sides 61A, 61B; the hole 64 is located at an equal distance from the adjacent sides 61B, 61C; and the hole 65 is located at an equal distance from the adjacent sides 61C, 61D, respectively. As to notches in which the vertical rod 5 of the holder 3 is fitted, notches 67, 68 are formed on the sides 61A, 61D, respectively, associated with the hole 62; notches 69, 70 on the sides 61A, 61B, respectively, associated with the hole 63; notches 71, 72 on the sides 61B, 61C, respectively, associated with the hole 64; and notches 73, 74 on the sides 61C, 61D, respectively, associated with the hole 65.

Figure 31:
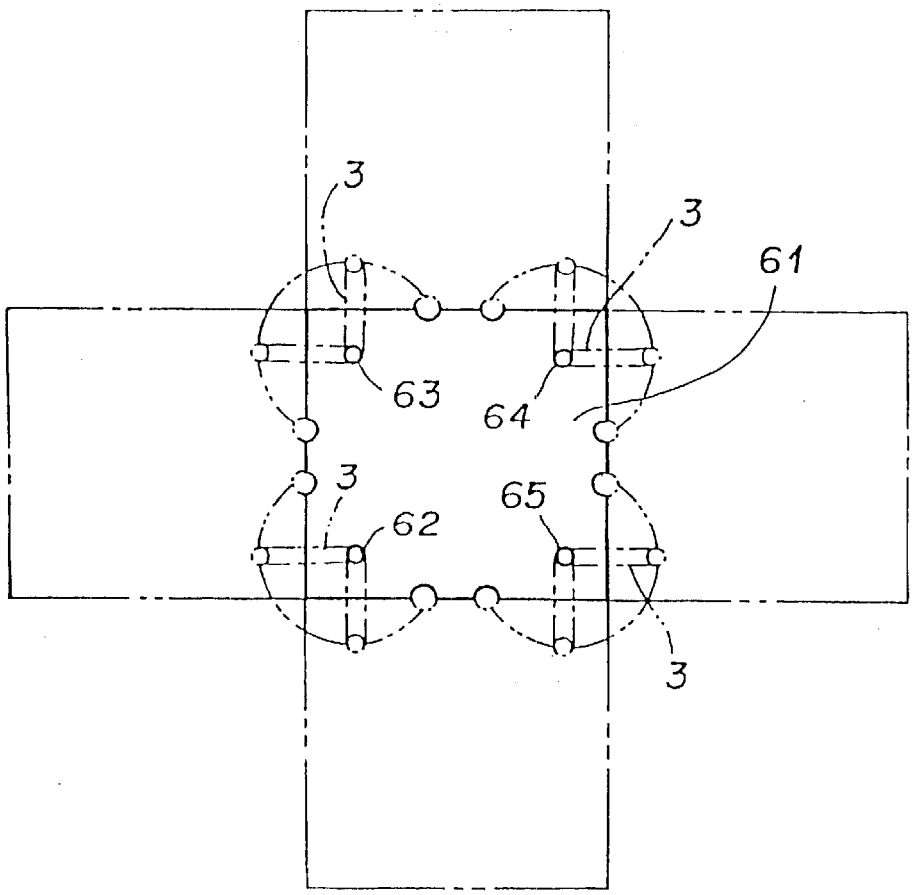
FIG. 31 is a top plan view illustrating how the puzzle of the tenth embodiment is used.

With the holes thus formed, the holder 3 may be inserted through either of the holes 62, 63, 64, 65 and pivoted as desired in one of two directions, as illustrated in FIG. 31, so that the card 61 can be turned over in any of the upward, downward, right and left directions. In addition, since the card 61 can be freely used in a rotated or reversed state, a wider variety of combinations can be created for the segmental pictures.

Figure 32:
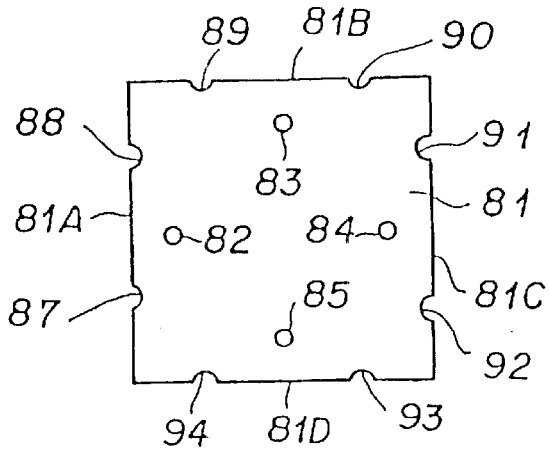
FIG. 32 is a top plan view illustrating a card forming part of a puzzle according to an eleventh embodiment of the present invention.

Next, an eleventh embodiment of the puzzle according to the present invention will be described with reference to FIGS. 32 and 33. The puzzle of this embodiment is comprised of a plurality of stacks as illustrated in FIG. 32 in combination. Each of square cards 81 constituting the stack is formed with four holes 82, 83, 84, 85, through which a holder 3 is inserted, in the vicinity of the center of all sides 81A, 81B, 81C, 81D at an equal distance from the center of the card 81 and in symmetric to each other. Also, as notches in which a vertical rod 5 of the holder 3 is fitted, notches 87, 88 are formed on the side 81A associated with the hole 82; notches 89, 90 are formed on the side 81B associated with the hole 83; notches 91, 92 are formed on the side 81C for the hole 84; and notches 93, 94 are formed on the side 81D associated with the hole 85. Each card 81 displays a segmental picture as mentioned above.

Figure 33:
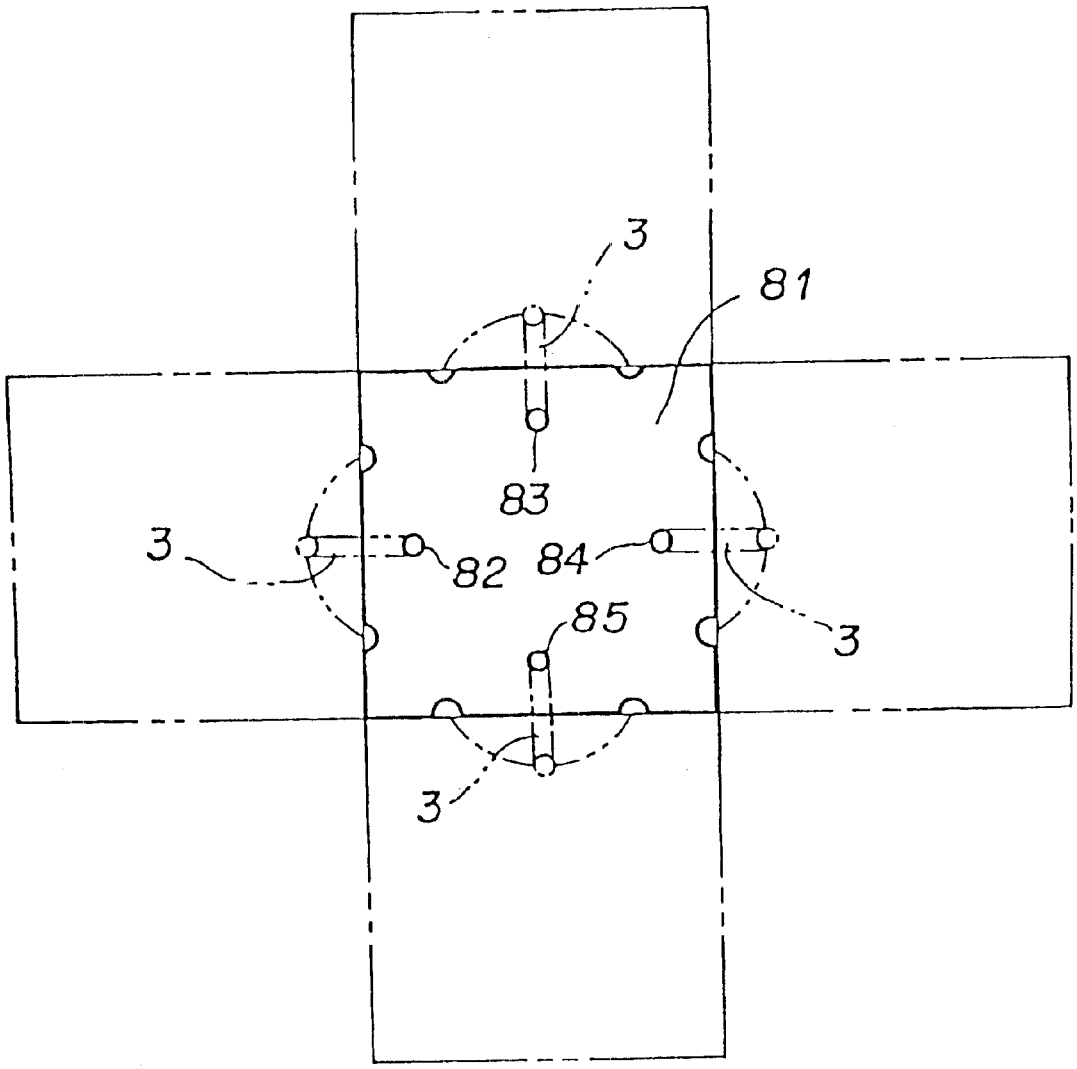
FIG. 33 is a top plan view illustrating how the puzzle of the eleventh embodiment is used.

With the holes thus formed, the stack is suitable for an application in which the card 81 is turned over in one of upward, downward, right and left directions by inserting the holder 3 through any of the holes 82, 83, 84, 85 as illustrated in FIG. 33. It should be noted that in the eleventh embodiment, since the four holes 82, 83, 84, 85 are at symmetrical positions, the card 81 can be freely used in a rotated or reversed state.

Figure 34:
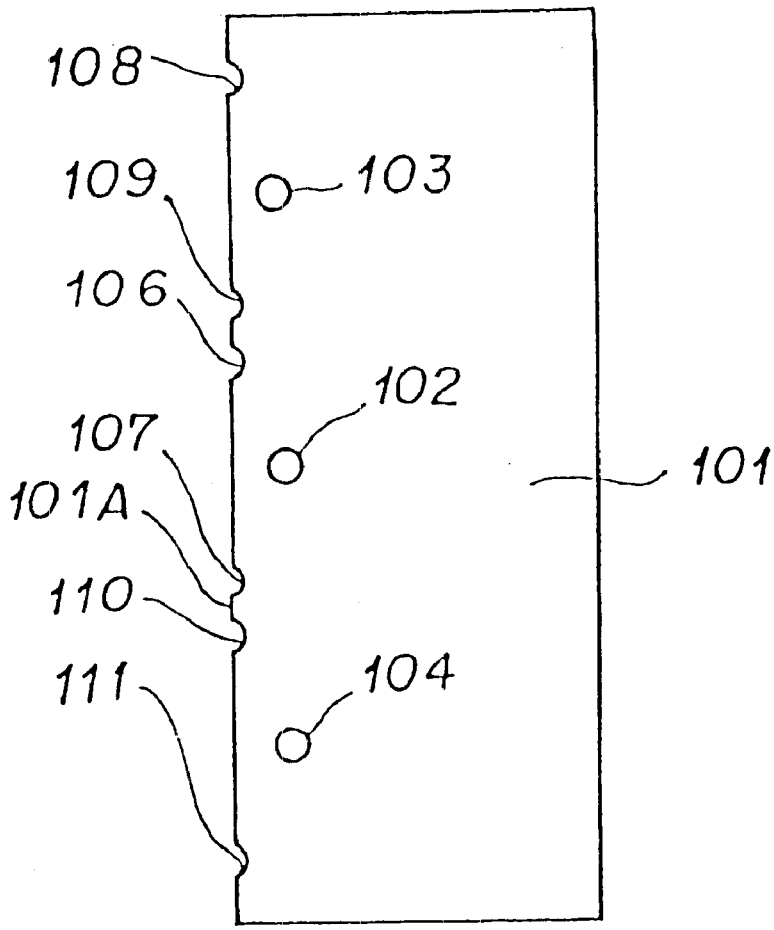
FIG. 34 is a top plan view illustrating a card forming part of a puzzle according to a twelfth embodiment of the present invention.
Figure 35:
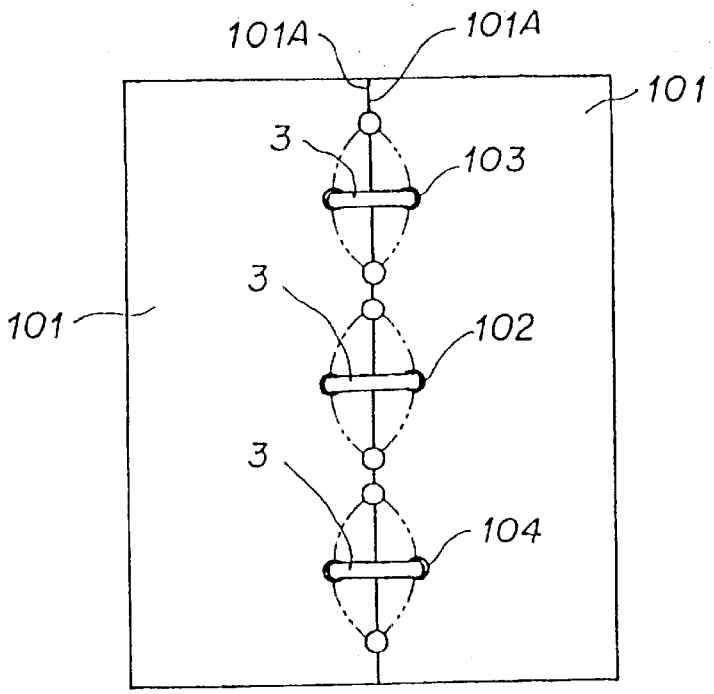
FIG. 35 is a top plan view illustrating how the puzzle of the twelfth embodiment is used.

Next, a twelfth embodiment of the puzzle according to the present invention will be described with reference to FIGS. 34 and 35. The puzzle of this embodiment is comprised of a plurality of stacks as illustrated in FIG. 34 in combination. Each of vertically longer rectangular cards 101 constituting the stack is formed with three holes 102, 103, 104, through which a holder 3 is inserted, along one side 101A thereof one by one in the vertical direction in the drawing. In this event, the hole 102 is located beside the center of the side 101A in the longitudinal direction, and the holes 103, 104 are located symmetrically about the hole 102. As notches in which a vertical rod 5 of the holder 3 is fitted, notches 106, 107 are formed on the side 101A associated with the hole 102; notches 108, 109 associated with the hole 103; and notches 110, 111 associated with the hole 104. This embodiment employs three holders 3 which are inserted through the respective holes associated therewith. Each card 101 displays a segmental picture as mentioned above.

As will be appreciated, the puzzle according to the twelfth embodiment is suitable for an elongated configuration just as an agenda.

Figure 36:
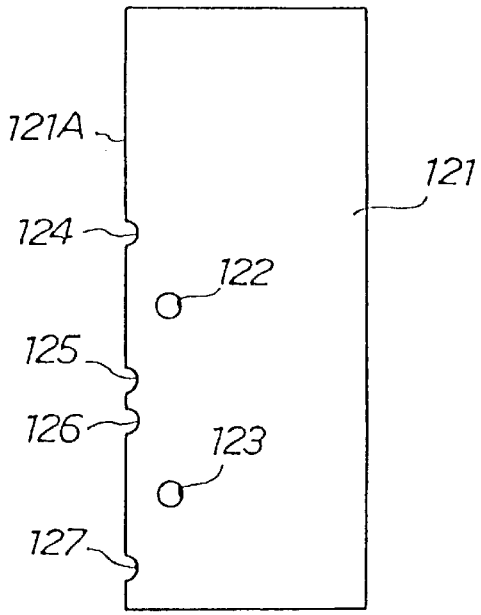
FIG. 36 is a top plan view illustrating a card forming part of a puzzle according to a thirteenth embodiment of the present invention.

Next, a thirteenth embodiment of the puzzle according to the present invention will be described with reference to FIGS. 36 and 37. The puzzle of this embodiment is comprised of a plurality of stacks as illustrated in FIG. 36 in combination. Each of vertically longer rectangular cards 121 constituting the stack is formed with two holes 122, 123, through which a holder 3 is inserted along one side 121A asymmetrically in the vertical direction in the figure. In addition, as notches in which a vertical rod of the holder 3 is fitted, notches 124, 125 are formed in the side 121A associated with the hole 122; and notches 126, 127 associated with the hole 123. This embodiment employs two holders 3 which are inserted through the respective holes associated therewith. Each card 121 displays a segmental picture as mentioned above.

Figure 37:
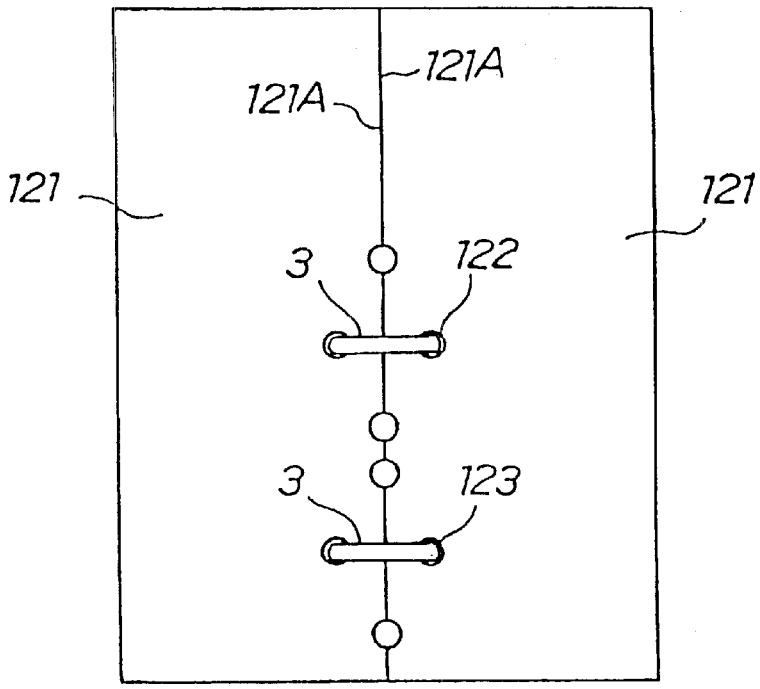
FIG. 37 is a top plan view illustrating how the puzzle of the thirteenth embodiment is used.

The holes thus formed through each card 121 advantageously prevent the player from erroneously adding a card 121 to the stack upside down, in case a segmental picture displayed on a card 121 is a complicated picture or figure, so that segmental pictures, when combined, can be made continuous without erroneous orientation, as illustrated in FIG. 37.

Figure 38:
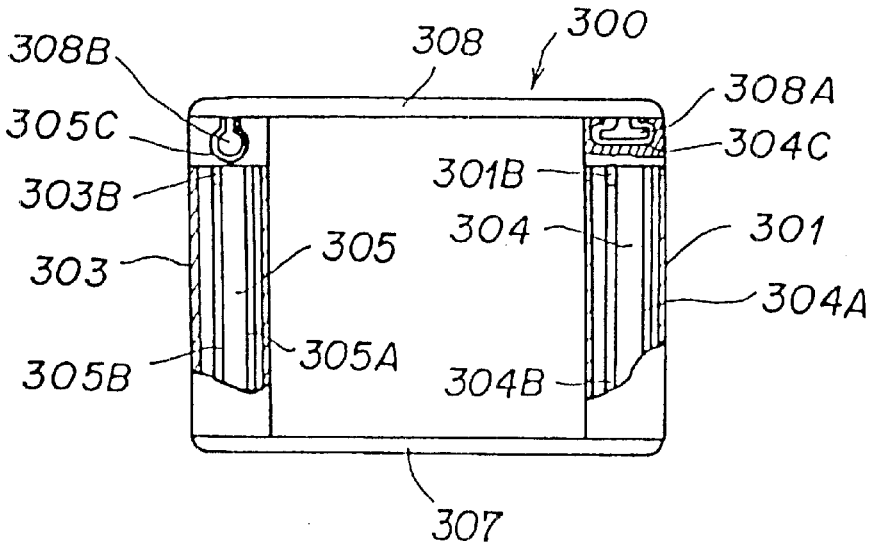
FIG. 38 is a partially cross-sectional front view illustrating a holder forming part of a puzzle according to a fourteenth embodiment of the present invention.
Figure 39A:
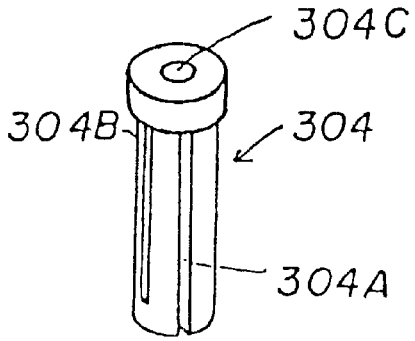
FIGS. 39A and 39B are perspective views each illustrating an inserted shaft constituting the holder of the fourteenth embodiment.
Figure 39B:
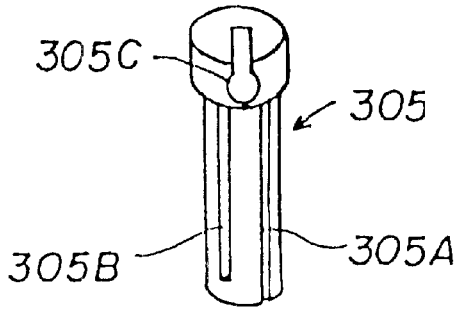

Next, a fourteenth embodiment of the puzzle according to the present invention will be described with reference to FIGS. 38 to 41 particularly for a holder 300 which has a different structure from that of the aforementioned first embodiment. Specifically, the holder 300 is quadrilateral and comprises hollow cylindrical vertical rods 301, 303 in which inserted shafts 304, 305 are removably fitted along the vertical direction in the figure. Specifically, the inserted shaft 304 is formed with a guide groove 304A and a stopper guide groove 304B as illustrated in FIG. 39A, while the inserted shaft 305 is formed with a guide groove 305A and a stopper guide groove 305B as illustrated in FIG. 39B.

Figure 40:
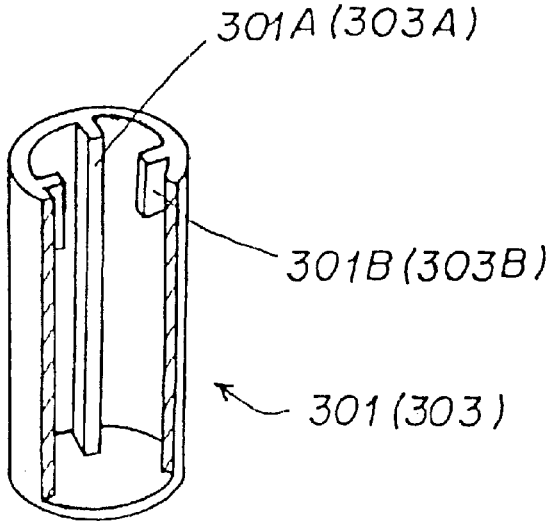
FIG. 40 is a partially cut-away perspective view illustrating a vertical rod constituting the holder of the fourteenth embodiment.

The guide grooves 304A, 305A are engaged with guide salients 301A, 303A, respectively, which are formed on the inner wall of the vertical rods 301, 303 as illustrated in FIG. 40, such that the inserted shafts 304, 305 can be slid into and out of the vertical rods 301, 303, as guided by the guide salients 301A, 303A, thereby making the vertical length of the holder 300 adjustable.

Figure 41:
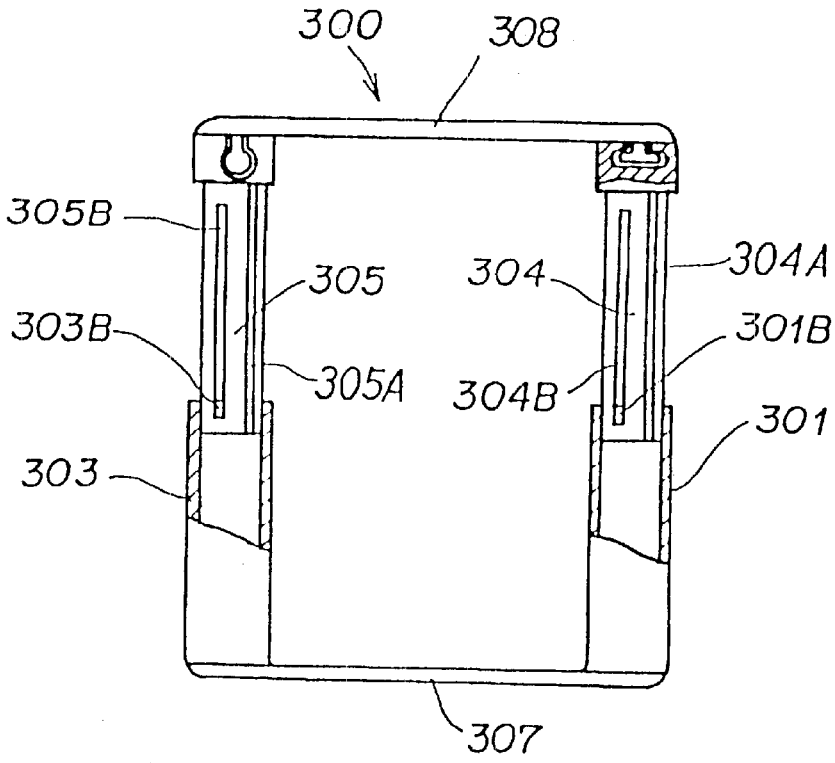
FIG. 41 is a partially cross-sectional front view illustrating the holder of the fourteenth embodiment when it is extended.

The stopper guide grooves 304B, 305B in turn are stopped by the stopper salients 301B, 303B, formed at the upper ends of the vertical rods 301, 303, respectively, so that the inserted shafts 304, 305 are prevented from coming off from the vertical rods 301, 303 even if they are maximally drawn out of the vertical rods 301, 303, as illustrated in FIG. 41. As is the case with the foregoing embodiments, the vertical rods 301, 303 are in parallel with each other, and one of the vertical rods is inserted through a hole 9 formed vertically through the respective cards 2.

A horizontal rod 307 is connected at a right angle with the lower ends of the vertical rods 301, 303. Also, a horizontal rod 308 is connected at a right angle with the upper ends of the vertical rods 301, 303 through the inserted shafts 304, 305, respectively.

The structure of the holder 300 will be described below in more detail with reference to FIG. 38. The inserted shaft 304 is formed with a recess 304C at the head thereof for rotatably supporting a fulcrum salient 308A formed at one end of the horizontal rod 308. The inserted shaft 305 is also formed with a recess 305C at the head thereof for removably holding a salient 308B formed at the other end of the horizontal rod 308, so that the salient 308B comes off from the recess 305C as the horizontal rod 308 is rotated, irrespective of where the inserted shafts 304, 305 are positioned with respect to the vertical rods 301, 303, to open the holder 300 between the horizontal rod 308 and the inserted shaft 305, as is the case with the aforementioned first embodiment.

According to the fourteenth embodiment, since the inserted shafts 304, 305 can be drawn up from or retracted into the vertical rods 301, 303 to adjust the length of the vertical rods 301, 303, the number of cards bound by the holder 300 can be freely changed.

Figure 42:
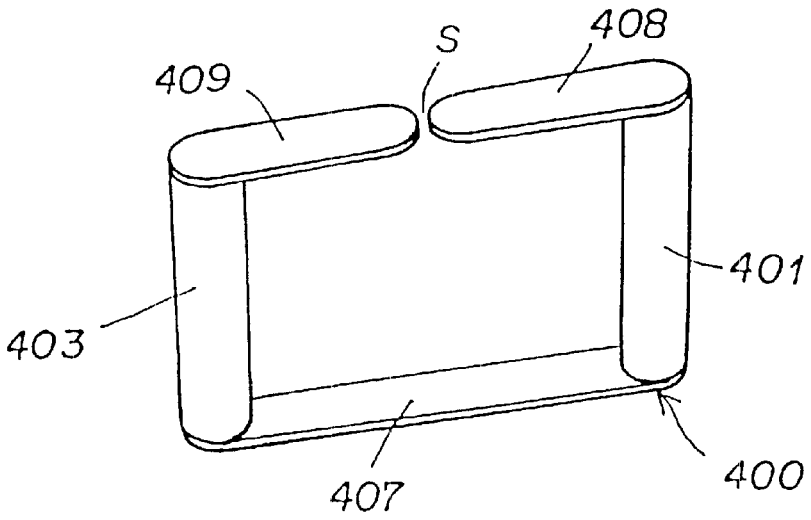
FIG. 42 is a perspective view illustrating a holder forming part of a puzzle according to a fifteenth embodiment of the present invention.

Next, a further holder 400 having a different structure will be shown below as a fifteenth embodiment with reference to FIG. 42. Since this holder 400 includes similar elements to those of the holder in the fifth embodiment, description will be only given to different elements. As illustrated in FIG. 42, the holder 400 has a horizontal rod 407 connected with the lower ends of cylindrical vertical rods 401, 403 which constitute a quadrilateral, and plate-like horizontal rods 408, 409 connected with the upper ends of the vertical rods 401, 403, respectively so as to form a gap S larger than the thickness of a card therebetween. With the structure described above, a card can be added to and removed from the vertical rods 401, 403 as required through the gap S.

Figure 43:
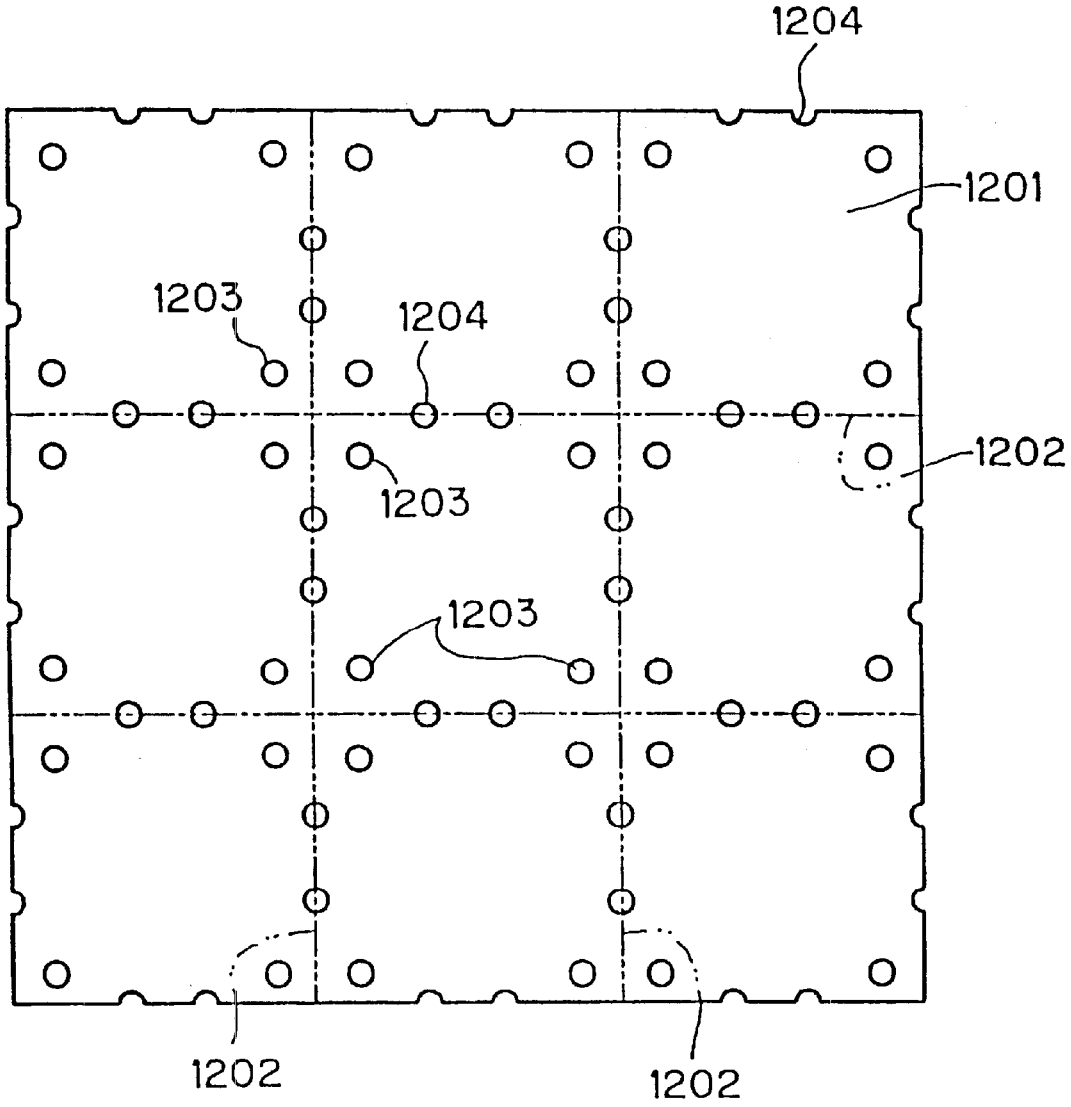
FIG. 43 is a top plan view of a first embodiment of a puzzle sheet from which cards are created according to the present invention.

Next, a first embodiment of a puzzle sheet for an creating cards constituting the aforementioned puzzle according to the present invention (hereinafter simply called the "sheet") will be described with reference to FIG. 43. This embodiment will be described for a specific example in which the cards 61 of the tenth embodiment are created. As illustrated in FIG. 43, a single square sheet 1201 having a continuous surface corresponding to the area occupied by a plurality of cards 61 arranged side by side is formed with cut lines 1202, which may be perforations or grooves, on both front and back sides, as indicated by two-dot chain lines. The cut lines 1202 serve as the boundaries of the respective cards, and accordingly as respective sides of separated cards. Further, the sheet 1201 are formed with a plurality of holes 1203 and notches 1204 corresponding to the holes 62 to 65, through which a holder is inserted, and the notches 67 to 74 provided in the cards 61 illustrated in FIG. 30 within respective areas defined by the cut lines 1202. The cut lines 1202, holes 1203, and notches 1204 may be formed in the sheet 1201 before or after pictures for the puzzles are displayed thereon by printing or the like.

The use of the sheet 1201 as described above facilitates the fabrication of the puzzle, because continuous cards on the sheet 1201 can readily display overall pictures, before separation, as compared with segmental pictures displayed on a required number of previously separated cards, and because respective cards can be readily separated by the cut lines 1202 from the sheet 1201 which displays overall pictures.

Figure 44:
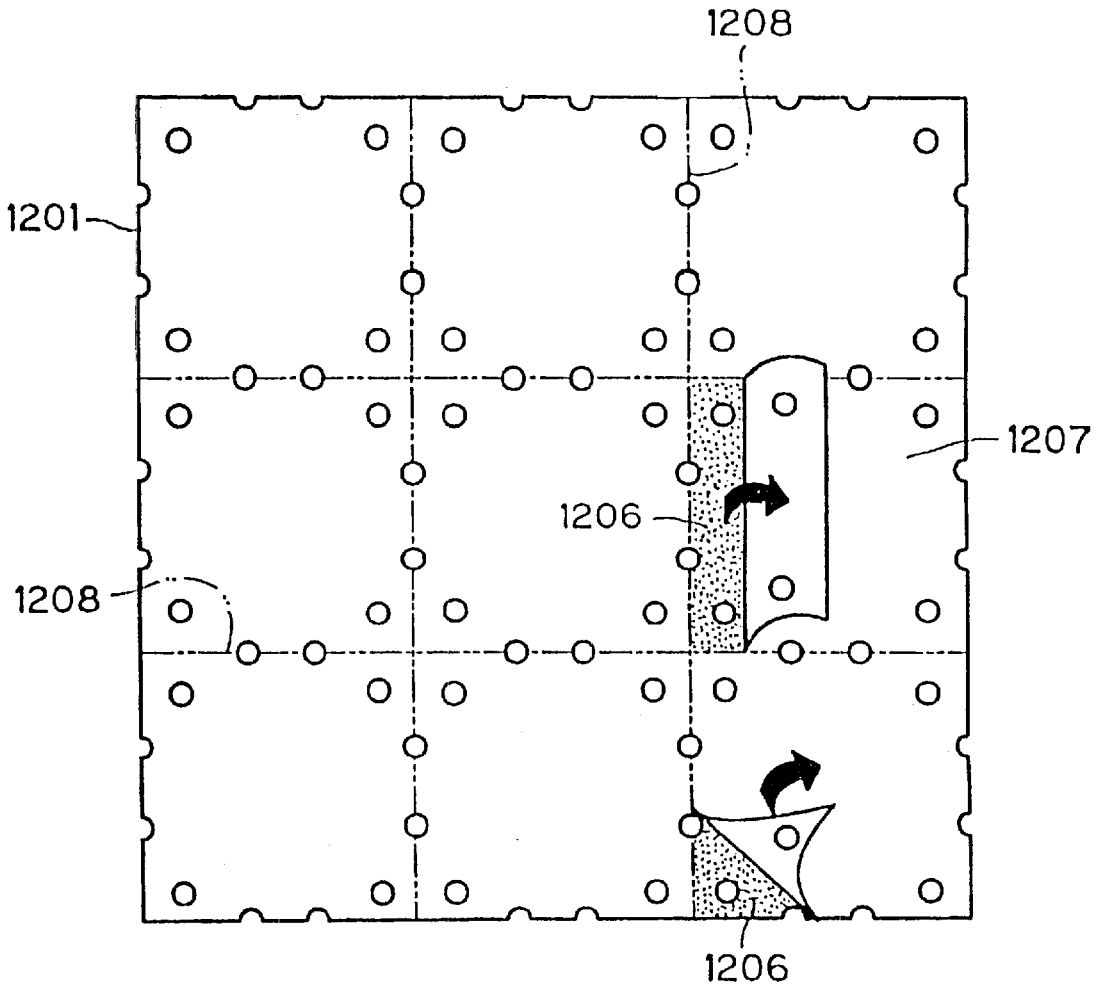
FIG. 44 is a top plan view of a second embodiment of the puzzle sheet from which cards are created according to the present invention.

FIG. 44 illustrates a second embodiment of the sheet which is similar to the sheet 1201 illustrated in FIG. 43. Segmental pictures for the puzzle are displayed on the front side of the sheet, and a glue 1206 is applied on the back side of the sheet. Further, a non-adhesive strippable paper 1207 is laminated on the glue 1206 to provide a so-called seal structure. The strippable paper 1207 is formed with cut lines 1208 coincident with the cut lines 1202 on the sheet 1201 as mentioned above, so that the sheet 1201 aminated with the strippable paper 1207 can be separated into pieces along the cut lines 1202, 1208. The pieces separated from the sheet 1201, i.e., card pieces 1210 separated by the cut lines 1202, 1208 are adhered two by two to create cards as described below. It should be noted that FIG. 44 illustrates a portion of the strippable paper 1207 partially peeled from the sheet 1201 along the cut line 1208 because the glue 1206 (indicated by shading in FIG. 44) applied on the back side of the sheet 1201 is indicated for convenience of explanation.

Figure 45:
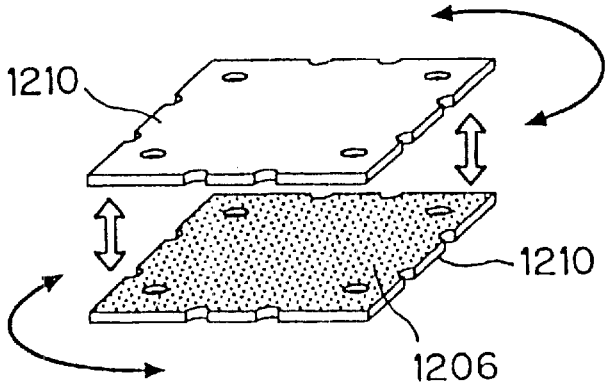
FIG. 45 is a perspective view illustrating how card pieces are adhered in the second embodiment.

After the sheet 1201 as described above is separated into a plurality of card pieces 1210 by the cut lines 1202, 1208, the strippable paper 1207 of each card piece 1210 is removed to readily adhere the back sides of two card pieces 1210 with the glue 1206, as illustrated in FIG. 45, with the result that one card can be created. Since the adhesion can be carried out after the respective card pieces 1210 are rotated in the clockwise direction or in the counterclockwise direction, a variety of combinations of positional relationships can be created between the front sides and back sides of the cards. Furthermore, such positional relationships can be previously confirmed without removing the strippable paper 1207 from the card piece 1210.

Figure 46:
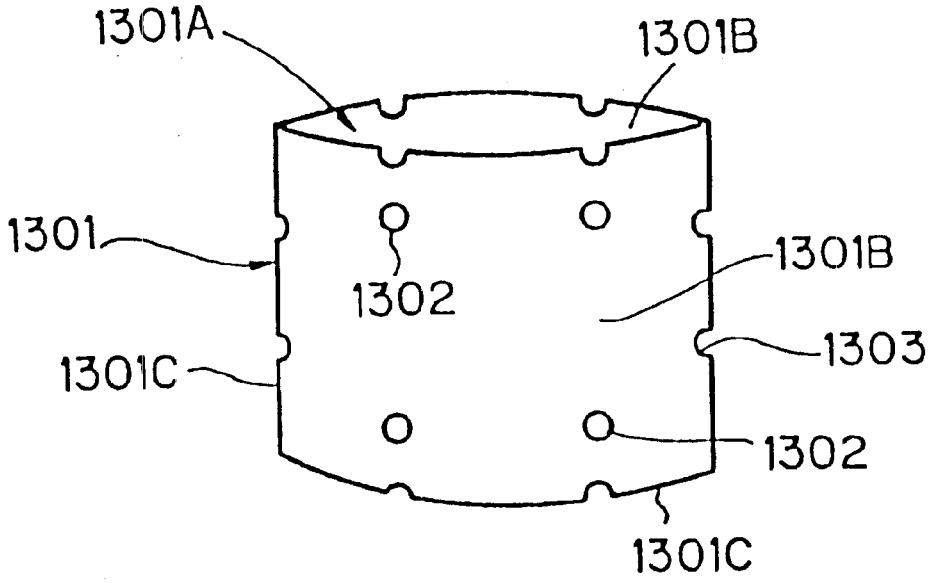
FIG. 46 is a three-dimensional view illustrating a first embodiment of a bag for keeping cards according to the present invention.

FIG. 46 illustrates a first embodiment of a bag for accommodating cards constituting the puzzle according to the present invention. The bag 1301 may be made of transparent vinyl or the like and is open only on the upper side which is formed as an opening 1301A. The bag 1301 can accommodate, for example, two stacked cards 61 of the tenth embodiment for keeping. In addition, the bag 1301 is formed with holes 1302 and notches 1303 through the two surfaces 1301B and fourth sides 1301C corresponding to the holes for inserting a holder therethrough and the notches formed through the cards 61.

When two stacked cards 61 are put in the bag 1301 with the respective segmental pictures facing outside, and a holder as mentioned above is inserted through any of the holes 1302 to bind the two cards 61, the cards 61 will not slip out of the bag 1301 or move in the bag 1301. In addition, since the bag 1301 is transparent, the segmental pictures of the cards 61 can be readily confirmed. Further, since the positional relationship between the two cards can be changed at any time, it is possible to create a wider variety of arrangements of the segmental pictures as a puzzle. A plurality of sets of two cards 61 each accommodated in the bag 1301 may be prepared for constituting a puzzle.

Figure 47:
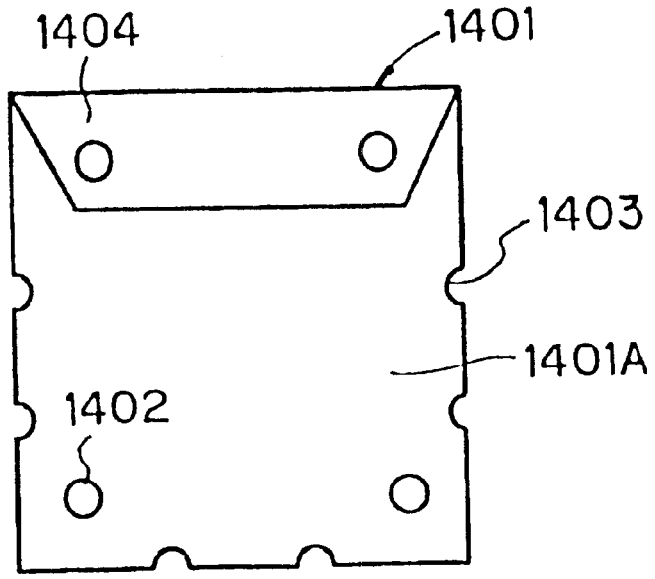
FIG. 47 is a three-dimensional view illustrating a second embodiment of the bag for keeping cards according to the present invention.

FIG. 47 illustrates a second embodiment of the bag for accommodating the cards. The illustrated bag 1401 is also formed with holes 1402 and notches 1403 similar to those in the first embodiment, and is additionally provided with a cover 1404 made of transparent vinyl for an opening, with the cover 1404 being applied with a lightly tacky adhesive on the back surface so that the cover 1404 can be attached to and removed from a bag body 1401A.

In this way, the opening is closed by the cover 1404 after cards 61 are put in the bag 1401, the position is changed, or the like, so that the cards 61 can be kept stationary in the bag 1401. In addition, even if water or the like is inadvertently dashed on the bag 1401. The cover 1404 protects the cards 61 from getting wet.

Next, several embodiments of card fixtures according to the present invention, which are conveniently utilized for fixing a plurality of cards constituting a puzzle to display a continuous overall picture, will be described below.

Figure 48:
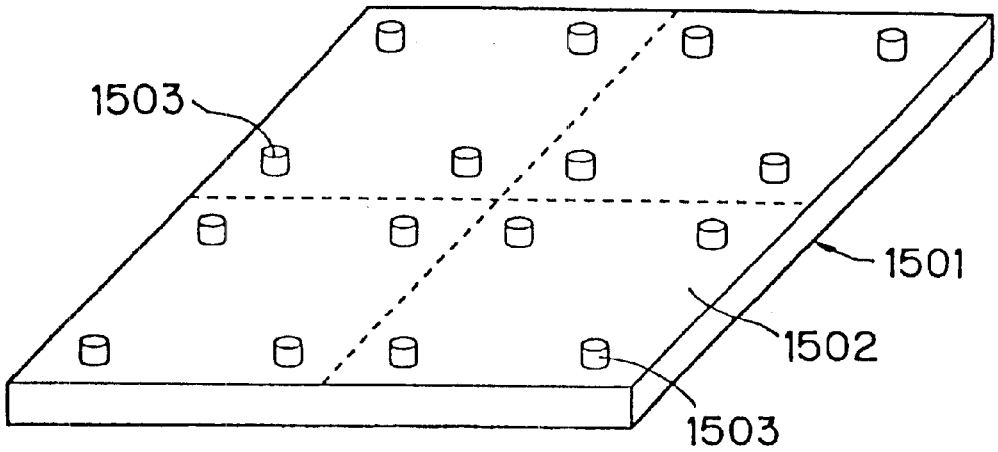
FIG. 48 is a perspective view illustrating a first embodiment of a card fixture according to the present invention.
Figure 49:
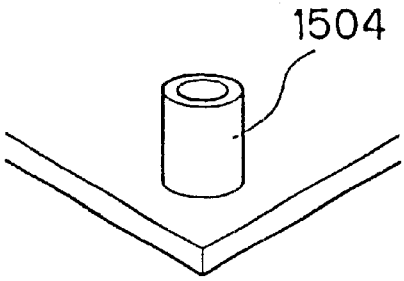
FIG. 49 is a perspective view illustrating another example of a protrusion on the card fixture of the first embodiment.

FIG. 48 illustrates a first embodiment of the card fixture. The illustrated card fixture 1501 is designed to fix up to four cards 61 of the aforementioned tenth embodiment (the same shall apply to the subsequent embodiments of the card fixture) The card fixture 1501 comprises a transparent substrate 1502 having the vertical and horizontal dimensions coincident with those of a set of four cards 61; and cylindrical protrusions 1503 disposed on the top surface of the substrate 1502 in the same positional relationship as the holes formed through the respective cards 61. The length of the protrusions 1503 may be determined in accordance with the thickness of the cards 61. Further, the protrusions 1503 may be formed as hollow pipe protrusions as illustrated in FIG. 49.

Figure 50:
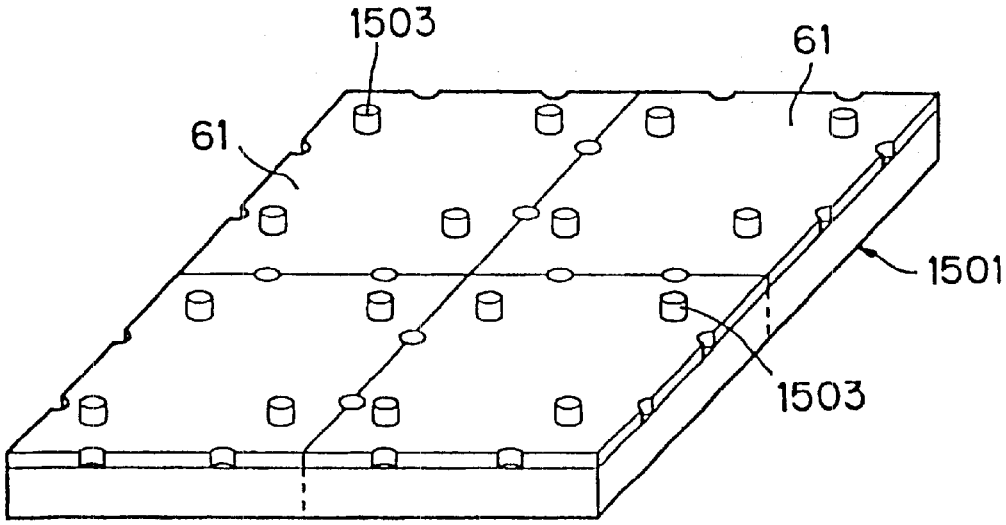
FIG. 50 is a perspective view illustrating cards fixed on the card fixture of the first embodiment.

According to the card fixture 1501 as described above, as four previously separated cards 61 are push down on the substrate 1502 with the respective holes guided by the protrusions 1503, the four cards 61 can be readily and correctly aligned and fixed on the card fixture 1501, as illustrated in FIG. 50. It is therefore possible to stably display a continuous overall picture on the four cards without causing any cards to move. Also, when the sheet 1201 as previously described in the second embodiment of the sheet is separated into card pieces 1210 and two card pieces 1210 are adhered to each other, the card fixture 1501 may be used to fix the card pieces 1210 with the holes of the cards guided by the protrusions 1503, the respective holes 1203 of the two card pieces 1210 can be correctly aligned.

Figure 51:
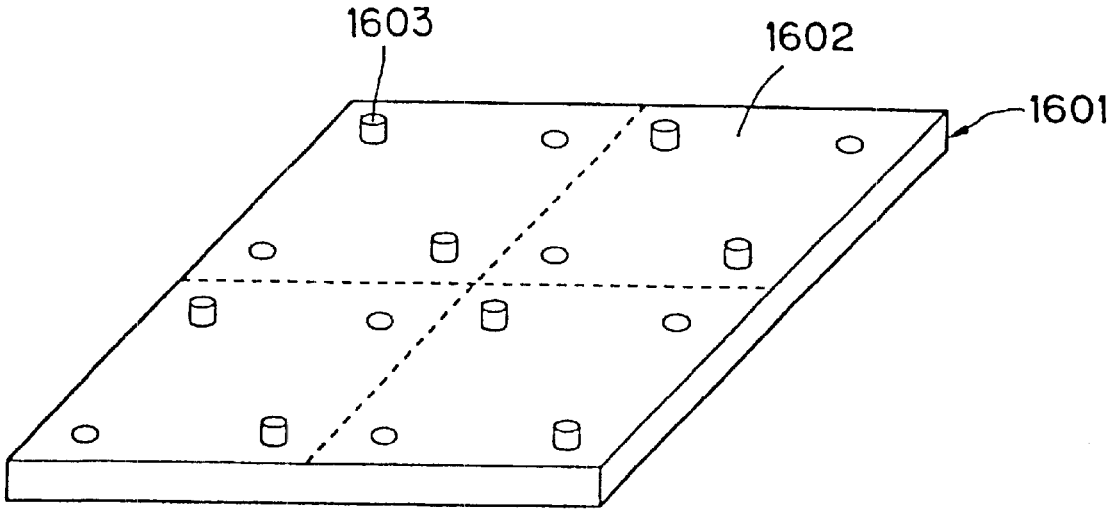
FIG. 51 is a perspective view illustrating a second embodiment of the card fixture according to the present invention.

FIG. 51 illustrates a second embodiment of the card fixture. While the card fixture 1601 of this embodiment is likewise designed to fix the cards 61 of the tenth embodiment, protrusions 1603 bonded on the top of a substrate 1602, similar to that in the first embodiment, are positioned diagonally so as to correspond to two holes on a diagonal line of the respective cards 61.

Figure 52:
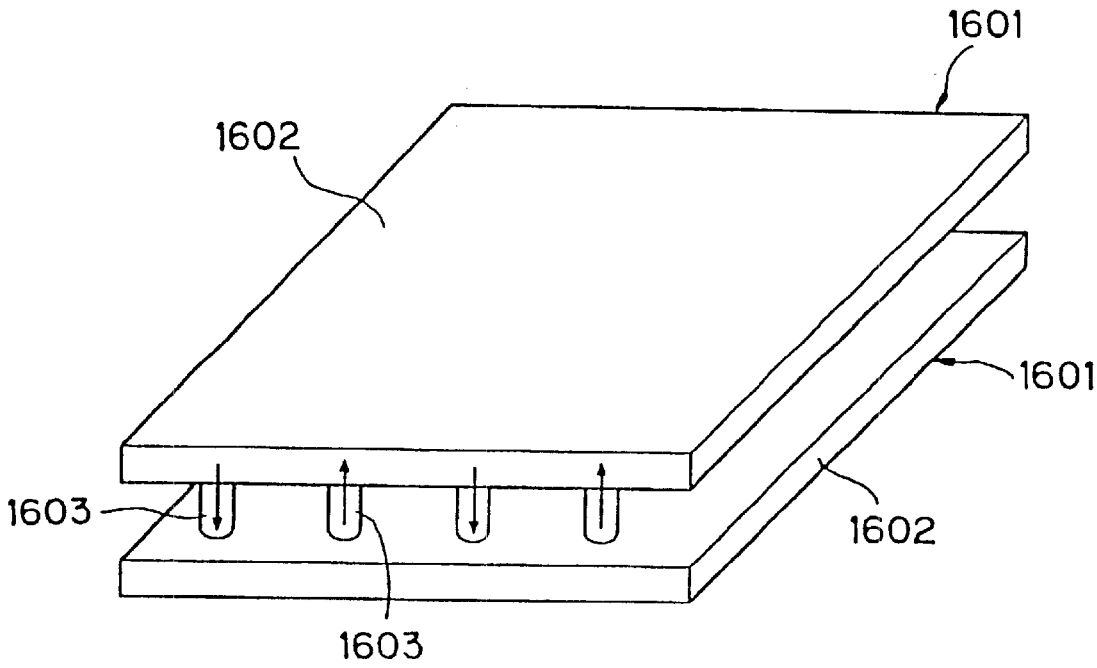
FIG. 52 is a perspective view illustrating how the card fixture of the second embodiment is used.

This embodiment can also fix a plurality of cards 61 at correct positions by use of the two protrusions 1603 for each card. In addition, two card fixtures 1601 may be prepared and used by laying one on the top of the other such that the top surfaces having the protrusions 1603 face each other as illustrated in FIG. 52. According to this usage, since the respective cards 61 are sandwiched between the two transparent substrates 1602, both front sides and back sides of the cards 61 can be visually confirmed. Then, the upper fixture 1601 may be removed to freely display an overall picture or segmental pictures on the front sides or back sides of the cards 61 remaining on the lower fixture 1601. Furthermore, when two card pieces 1210 separated from the sheet 1201 as described in the aforementioned second embodiment are laid one on top of the other and sandwiched between the two substrates 1602, the positional relationship between the two card pieces 1210 can be readily changed if the upper fixture 1601 is removed.

Figure 53:
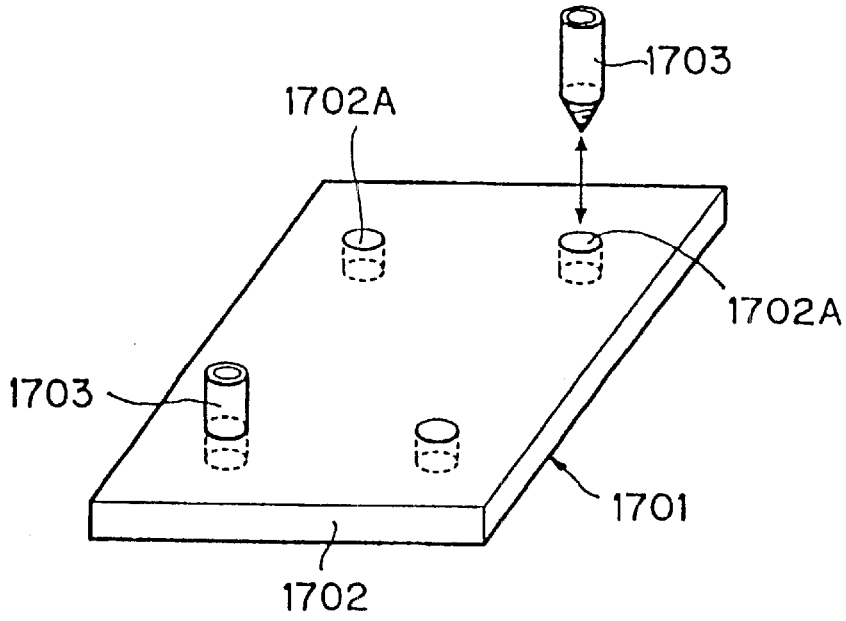
FIG. 53 is a perspective view illustrating a third embodiment of the card fixture according to the present invention.
Figure 54:
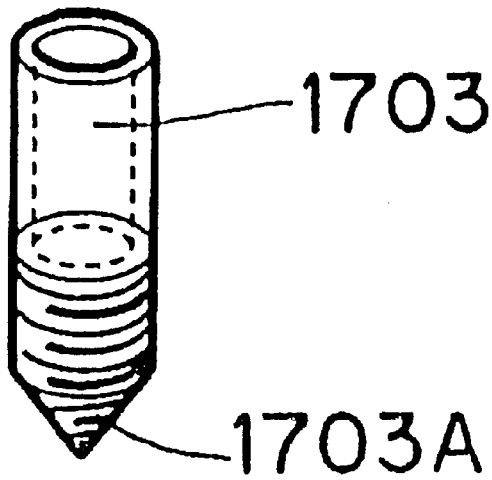
FIG. 54 is an enlarged perspective view illustrating a protrusion on the card fixture of the third embodiment.

FIG. 53 illustrates a third embodiment of the card fixture. The illustrated card fixture 1701 comprises a transparent substrate 1702; and two hollow pipe protrusions 1703 removably arranged and positioned diagonally on the top surface of the substrate 1702 so as to correspond to two holes on a diagonal line of a card 61. The protrusion 1703 has a lower threaded portion 1703A for screwing into a screw hole 1702A formed in the substrate 1702, as illustrated in FIG. 54. The protrusion 1703 may be of a cylindrical shape instead of the hollow pipe.

By removably arranging the protrusions 1703 as described above, the protrusions 1703 may be removed from the substrate 1702 when the card fixture 1701 is not in use, so that the card fixture 1701 can be reduced in size to facilitate the accommodation thereof.

Figure 55:
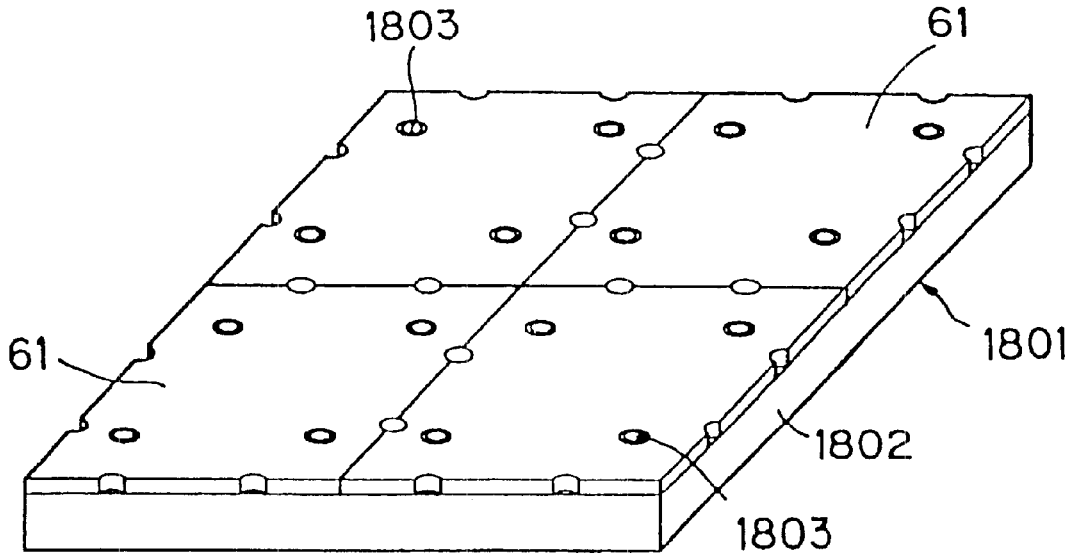
FIG. 55 is a perspective view illustrating a fourth embodiment of the card fixture according to the present invention.
Figure 56:
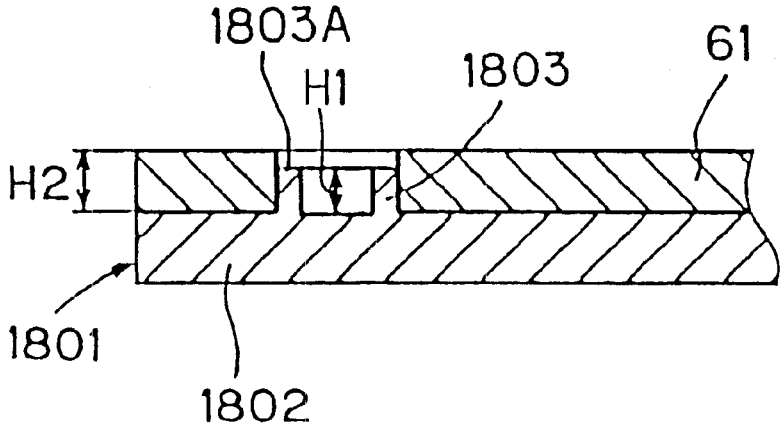
FIG. 56 is an enlarged cross-sectional view illustrating a card fixed on the card fixture of the fourth embodiment.

FIG. 55 illustrates a fourth embodiment of the card fixture. The illustrated card fixture 1801 comprises a transparent substrate 1802 having the vertical and horizontal dimensions coincident with those of a set of four cards 61; and hollow pipe protrusions 1803 disposed on the top surface of the substrate 1802 in the same positional relationship as the holes formed through the respective cards 61. The length H1 of the protrusions 1803 is set to be identical or slightly smaller than the thickness H2 of the card 61 which is to be fixed on the substrate 1802, as illustrated in FIG. 56.

According to the structure as described above, an upper end 1803A of the protrusion 1803 will not obstruct when a picture is displayed on a card. In addition, since the protrusion 1803 is made of a hollow pipe, it is possible to prevent a picture from erroneously being displayed on the upper end surface 1803A of the protrusion 1803.

Figure 57:
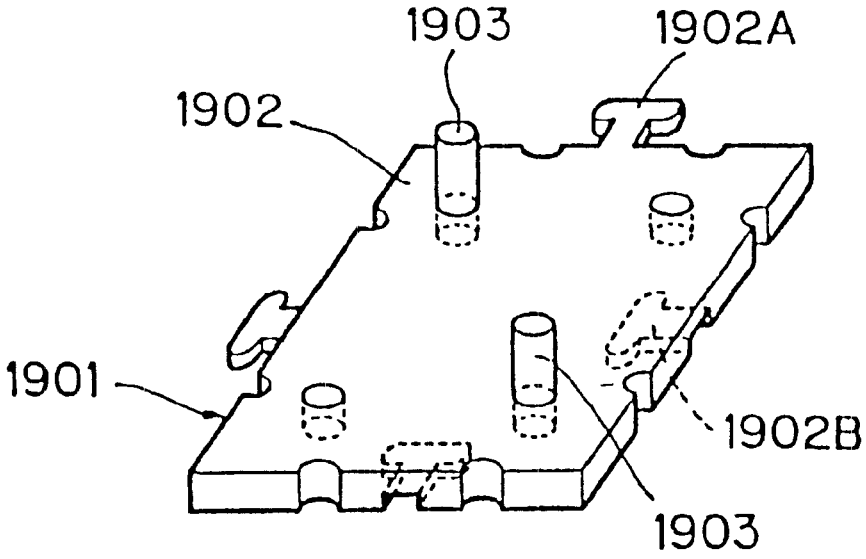
FIG. 57 is a perspective view illustrating a fifth embodiment of the card fixture according to the present invention.
Figure 58:
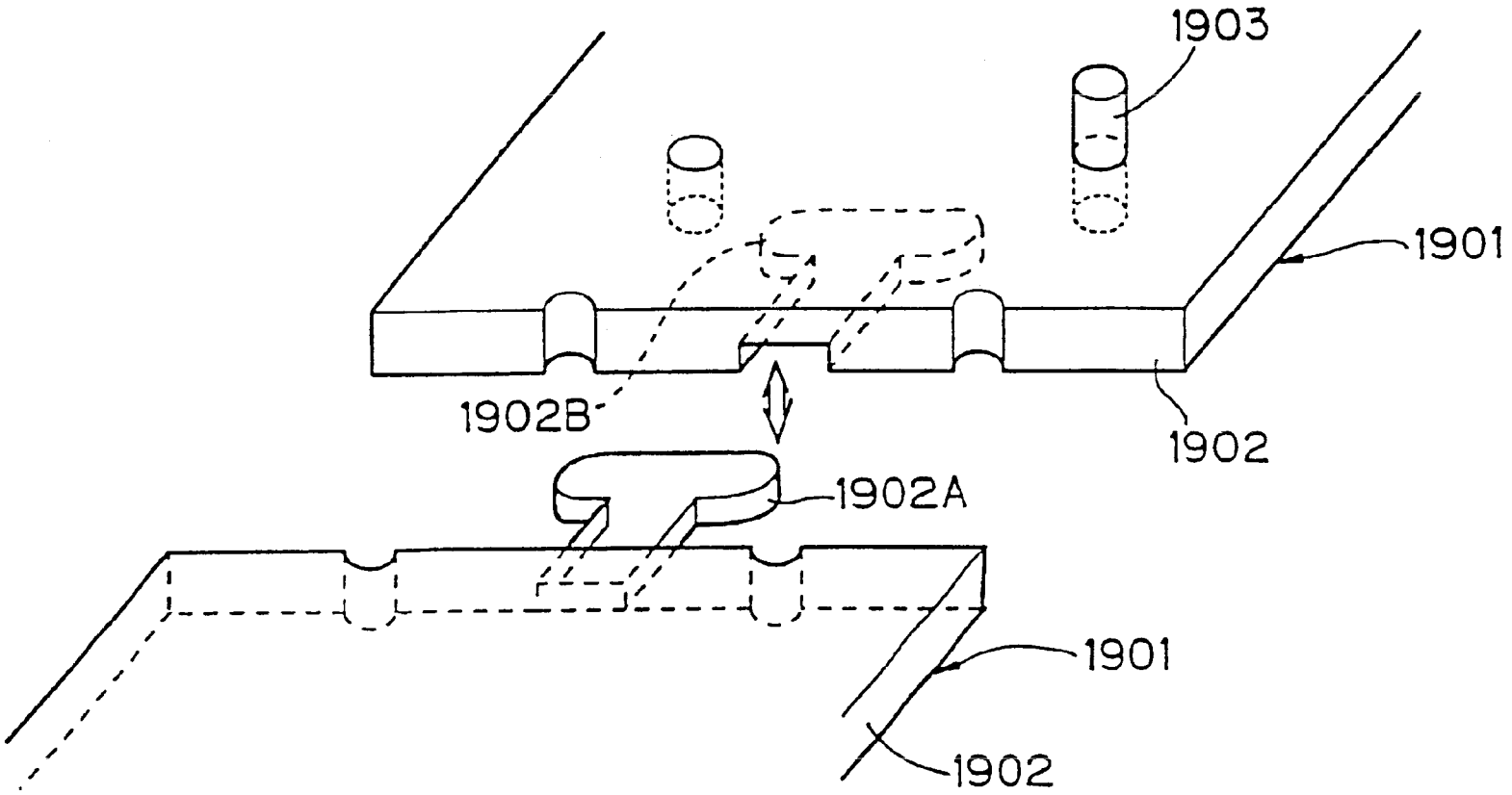
FIG. 58 is an enlarged perspective view illustrating a salient and an undercut of the card fixtures of the fifth embodiment.
Figure 59:
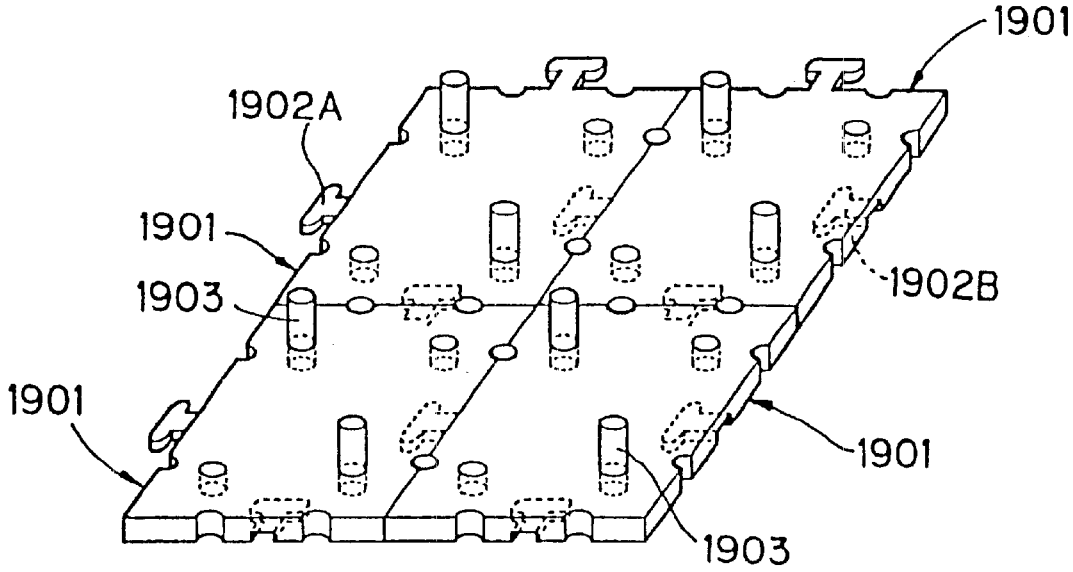
FIG. 59 is a perspective view illustrating the card fixtures joined together in the fifth embodiment.

FIGS. 57 to 59 illustrate a fifth embodiment of the card fixture. As illustrated in FIG. 57, the card fixture 1901 comprises a transparent substrate 1902 having the dimensions coincident with those of a separated card 61; hollow pipe protrusions 1903 disposed on the top surface of the substrate 1902; and salients 1902A and undercuts 1902B on four sides of the substrate 1902. When in use, a plurality of card fixtures 1901 are prepared and joined as described below, in which case, the salient 1902A of one card fixture 1901 is fitted into the undercut 1902B of the adjacent card fixture 1901 as illustrated in FIG. 58.

The card fixtures 1901 may be used in the following manner. For example, when there are four previously separated cards 61, four card fixtures 1901 are prepared, and joined by mutually fitting the salient 1902A of one card fixture 1901 into the undercut 1902B of the adjacent card fixture 1901. With this state maintained, four cards are fixed on the four card fixtures 1901 using the protrusions 1903, so that required pictures may be displayed on the fixed cards. Thus, since the fifth embodiment only has to prepare a number of card fixtures 1901 required in accordance with the number of cards 61, and eliminates the need for preparing a variety of card fixtures each comprising an integrally formed substrate beforehand in accordance with the number of cards, as is the case with the first to fourth embodiments, this type of card fixture 1901 is convenient for carrying.

Figure 60:
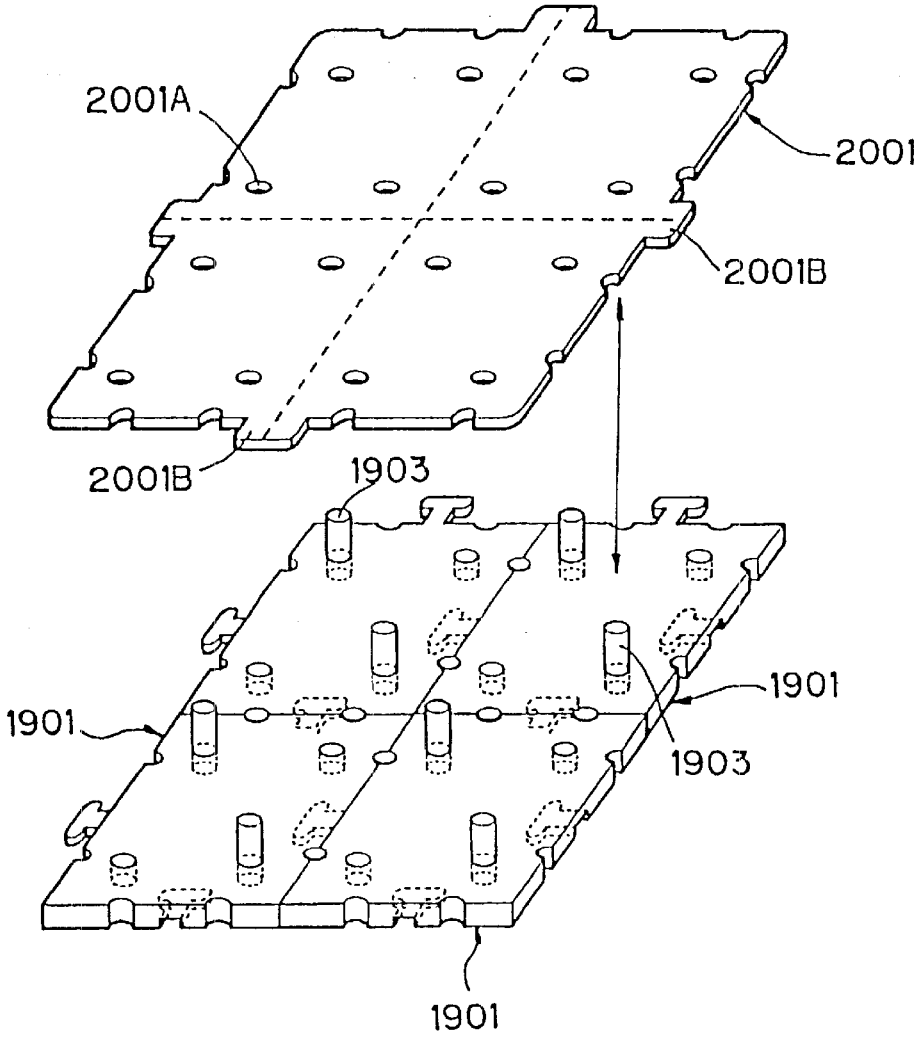
FIG. 60 is a perspective view illustrating an intermediate layer used in combination with a card fixture according to an embodiment of the present invention.
Figure 61:
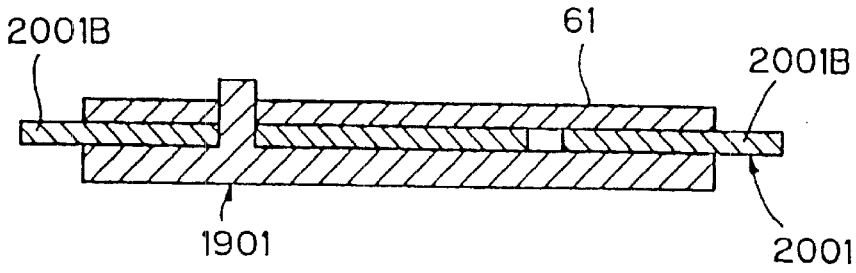
FIG. 61 is an enlarged cross-sectional view illustrating the intermediate layer of FIG. 60 in a used state.
Figure 62:
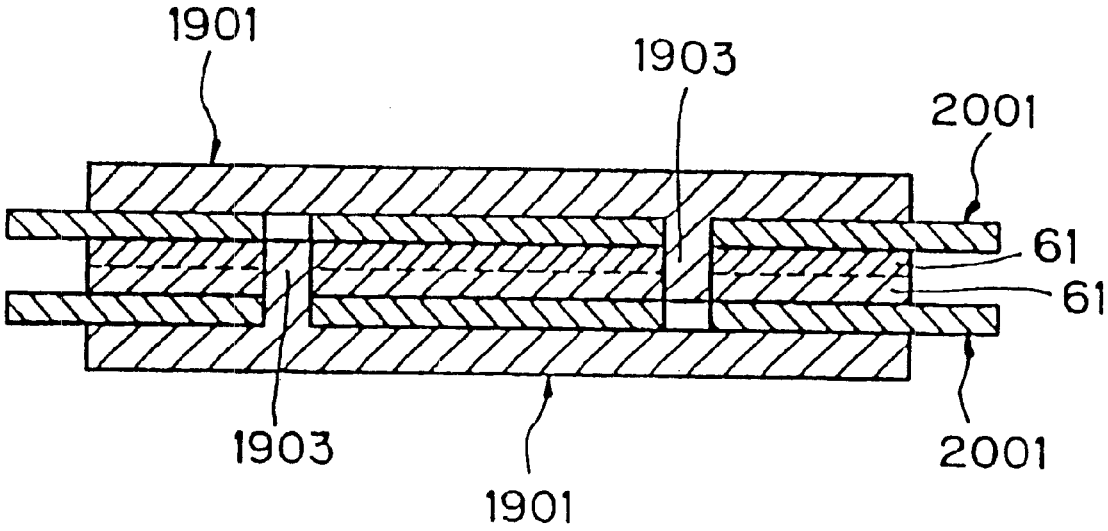
FIG. 62 is an enlarged cross-sectional view illustrating the intermediate layer of FIG. 60 in another used state.

Next, an embodiment of an intermediate layer for use in combination with the card fixture(s) will be described with reference to FIGS. 60 to 62. The intermediate layer 2001 may be made of a transparent material, and has a size large enough to cover the entire top surface formed, for example, by joining a plurality of card fixtures 1901 described in the fifth embodiment, as illustrated in FIG. 60. The intermediate layer 2001 is formed with holes 2001A passed through by the protrusions 1903 of the card fixtures 1901, and salients 2001B on the peripheral sides.

The intermediate layer 2001 as described is aligned to and laid over a plurality of previously joined card fixtures 1901, while the protrusions 1903 of the card fixtures 1901 are inserted through the holes 2001A. Next, the same number of cards 61 as that of the card fixtures 1901 are placed on the intermediate layer 2001, making use of the salients 1903 protruding from the intermediate layer 2001. FIG. 61 is a cross-sectional view illustrating that the card fixtures 1901, the intermediate layer 2001 and the cards 61 are laid one on top of the other in the manner described above. In this case, since the intermediate layer 2001 is transparent, the state of the cards 61 can be observed, when viewed from the lower side of the card fixtures 1901. Thus, information required for creation may be written on the intermediate layer with an erasable marker or the like and erased therefrom to help the creator create and devise an overall picture or segmental pictures.

For removing the plurality of cards 61 from the card fixtures 1901 by turning the stack of the card fixtures 1901, the intermediate layer 2001 and the cards 61 upside down, a salient 2001B of the intermediate layer 2001 may be held and drawn to separate the intermediate layer 2001 from the card fixtures 1901 to readily remove the cards 61 from the card fixtures 1901.

The card fixtures 1901 and the intermediate layer 2001 may be used in the following manner. As illustrated in FIG. 62, two stacked cards 61 are placed on the intermediate layer 2001 laid on top of the card fixture 1901 on the lower side in the drawing, and another intermediate layer 2001 is placed on the cards 61. Further, on the intermediate layer 2001, another card fixture 1901 is placed such that its protrusions 1903 face the protrusions 1903 of the lower card fixture 1901. In this way, since the card fixtures 1901 and the intermediate layer 2001 are both transparent, such an assembly is convenient for confirming the states of the front side and back side of the cards 61, and for adjusting the position of the cards 61.

While the present invention has been described above with reference to specific embodiments thereof, it goes without saying that the present invention is not limited to the foregoing embodiments, and a variety of modifications and alterations may be made thereto by those skilled in the art without departing from the spirit and scope of the invention. For example, a variety of shapes may be employed for the cards other than those described above as long as the ensured continuity of associated segmental pictures, the ease of accommodation in a box, and so on are satisfied. It is also possible to employ in a variety of forms the meaning, contents, manner, method, and so on of segmental pictures on cards, and the order in which cards are arranged in a stack. It is further possible to provide a card with any appropriate number of holes, through which a holder is inserted, and notches in which a holder is fitted, as well as to modify the shape of the holder which is inserted through the hole, for example, rounding the entirety or part of the holder, and rounding a portion at which a vertical rod is connected with a horizontal rod. Further, as to the second embodiment of the sheet, the glue applied to card pieces need not be applied to all card pieces but only to appropriately selected card pieces, in which case a card may be created by adhering a card piece applied with the glue and a card piece not applied with the glue. The substrate forming part of the card fixture may be made of an opaque material instead of a transparent material. In the second embodiment onward of the card fixtures, the protrusions formed on the substrate are disposed diagonally, but the protrusions may be disposed in parallel along each side of the substrate. The intermediate layer may be made of an opaque material instead of a transparent material.

As described above, the present invention can provide a puzzle in the form of stacks which eliminates troublesome handling, and exhibits high versatility as amusement; sheet materials suitable for creating cards constituting a puzzle; bags suitable for adjusting a positional relationship of cards; card fixtures suitable for facilitating the display of pictures on cards forming part of the puzzle; and an intermediate layer which facilitates removable of cards, once fixed to the card fixture, from the card fixture.

What is claimed is:

1. A puzzle for reconstructing an overall picture by assembling a plurality of segmental pictures divided from said overall picture, comprising:

a number of stacks equal to the number of segmental pictures, each of said stacks including a plurality of cards and a holder inserted through a hole formed through each of said cards, and each of said cards includes a notch formed on at least one side thereof for fitting said holder therein when said holder is rotated about a portion thereof extending through said hole, said notch having a depth equal to or larger than a thickness of said holder, each of said card displaying one of said segmental pictures, wherein cards displaying associated segmental pictures divided from the same overall picture are selected from each of said plurality of stacks for exposure, and assembled to reconstruct said overall picture.

2. The puzzle according to claim 1, wherein each of said card includes reconstruction information for reconstructing an overall picture associated with a segmental picture displayed thereon.

3. The puzzle according to claim 2, wherein said stack further includes a holder inserted through a hole formed through each of said cards.

4. The puzzle according to claim 3, wherein each of said cards is formed with a plurality of holes, and said stack includes a plurality of holders.

5. The puzzle according to claim 2, wherein said stack further includes a holder inserted through a hole formed through each of said cards, and each of said cards includes a notch formed on at least one side thereof for fitting said holder therein when said holder is rotated about a portion thereof extending through said hole, said notch having a depth equal to or larger than a thickness of said holder.

6. The puzzle according to claim 5, wherein each of said cards is formed with a plurality of holes, and said stack includes a plurality of holders.

7. The puzzle according to claim 1, wherein said stack further includes a holder inserted through a hole formed through each of said cards.

8. The puzzle according to claim 7, wherein each of said cards is formed with a plurality of holes, and said stack includes a plurality of holders.

9. The puzzle according to claim 1, wherein each of said cards is formed with a plurality of holes, and said stack includes a plurality of holders.

10. A puzzle for reconstructing an overall picture by assembling a plurality of segmental pictures divided from said overall picture, comprising:

a puzzle body including a number of stacks equal to the number of segmental pictures, each of said stacks including a plurality of cards and a holder inserted through a hole formed through each of said cards, and each of said cards includes a notch formed on at least one side thereof for fitting said holder therein when said holder is rotated about a portion thereof extending through said hold, said notch having a depth equal to or larger than a thickness of said holder, each of said card displaying one of said segmental pictures, wherein cards displaying associated segmental pictures divided from the same overall picture are selected from each of said plurality of stacks for exposure, and assembled to reconstruct said overall picture; and a reconstruction information stack including a plurality of cards, each of said cards including reconstruction information for reconstructing an overall picture associated with a segmental picture displayed thereon, and a field for a player to write said reconstruction information.

11. The puzzle according to claim 10, wherein said stack further includes a holder inserted through a hole formed through each of said cards.

12. The puzzle according to claim 11, wherein each of said cards is formed with a plurality of holes, and said stack includes a plurality of holders.

13. The puzzle according to claim 10 wherein each of said cards is formed with a plurality of holes, and said stack includes a plurality of holders.

* * * * *